United States Patent [19]

Terragnoli

[11] Patent Number: 4,852,329

[45] Date of Patent: Aug. 1, 1989

[54] METHOD AND APPARATUS FOR HOLDING A PLURALITY OF OBJECTS IN A TAPE-WRAPPED BUNDLE

[75] Inventor: Louis Terragnoli, Williamsville, N.Y.

[73] Assignee: A. J. Panneri Enterprises, Inc., Buffalo, N.Y.

[21] Appl. No.: 139,948

[22] Filed: Dec. 31, 1987

Related U.S. Application Data

[63] Continuation-in-part of Ser. No. 944,430, Dec. 18, 1986, abandoned.

[51] Int. Cl.[4] ..... B65B 13/04; B65B 27/06

[52] U.S. Cl. ..... 53/399; 53/204; 53/229; 53/372; 53/409; 53/419; 53/466; 53/583; 53/586

[58] Field of Search ..... 53/399, 419, 466, 210, 53/526, 583, 590, 229, 586, 371, 372, 409, 204; 156/481, 485, 477.1

[56] References Cited

U.S. PATENT DOCUMENTS

| | | | |
|---|---|---|---|
| 1,949,544 | 3/1934 | Mateson | 53/586 X |
| 2,865,153 | 12/1958 | Seragnoli | 53/372 X |
| 3,000,151 | 9/1961 | Winkler | 53/586 |
| 3,021,653 | 2/1962 | Marshal | 53/586 X |
| 3,340,882 | 9/1967 | Holmes | 53/229 |
| 3,518,806 | 7/1970 | Davidson | 53/586 X |
| 4,276,736 | 7/1981 | Haberstroh | 53/586 X |
| 4,617,784 | 10/1986 | Golicz | 53/586 X |
| 4,739,605 | 4/1988 | Takamura | 53/586 X |

FOREIGN PATENT DOCUMENTS

| | | | |
|---|---|---|---|
| 18604 | 8/1956 | Fed. Rep. of Germany | 53/590 |

*Primary Examiner*—John Sipos
*Attorney, Agent, or Firm*—Joseph P. Gastel

[57] ABSTRACT

A device for wrapping a plurality of objects together into a tape-wrapped bundle includes a frame having an open-mouth recess, a quantity of one-sided cohesive tape, a pair of advance rollers mounted on the frame and selectively operable to advance a length of the tape, with the sticky substance thereon facing away from the recess, across the mouth of the recess such that, when objects are thereafter inserted into the recess, the advanced tape length will be gathered in the recess, a pair of relatively movable jaws, mounted on the frame and operatively arranged to selectively press together portions of the leading and trailing tape parts proximate the mouth of the recess, a wiping blade mounted on the pressing member for horizontal movement therewith but mounted for selective vertical movement relative thereto for progressively increasing the length of such pressed-together portions in a direction toward the objects, and a guillotine cutting blade assembly for cutting the extreme ends of the leading and trailing tape parts flush with each other. In addition the machine includes guide channels for guiding the tape so that the sides of the pressed-together leading and trailing tape parts are flush with each other. In use, the improved apparatus provides an improved method of tape-wrapping a plurality of objects into a bundle.

31 Claims, 8 Drawing Sheets

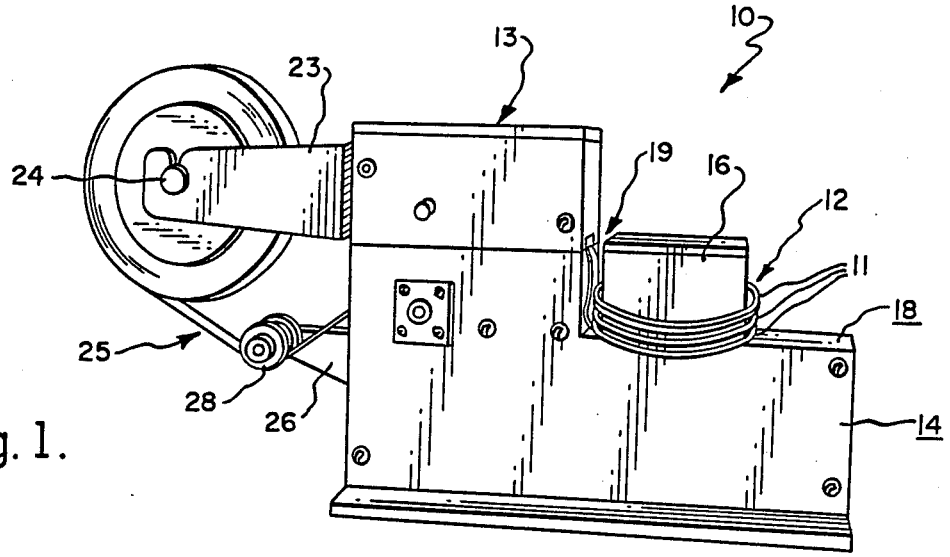
Fig. 1.
Fig. 2.
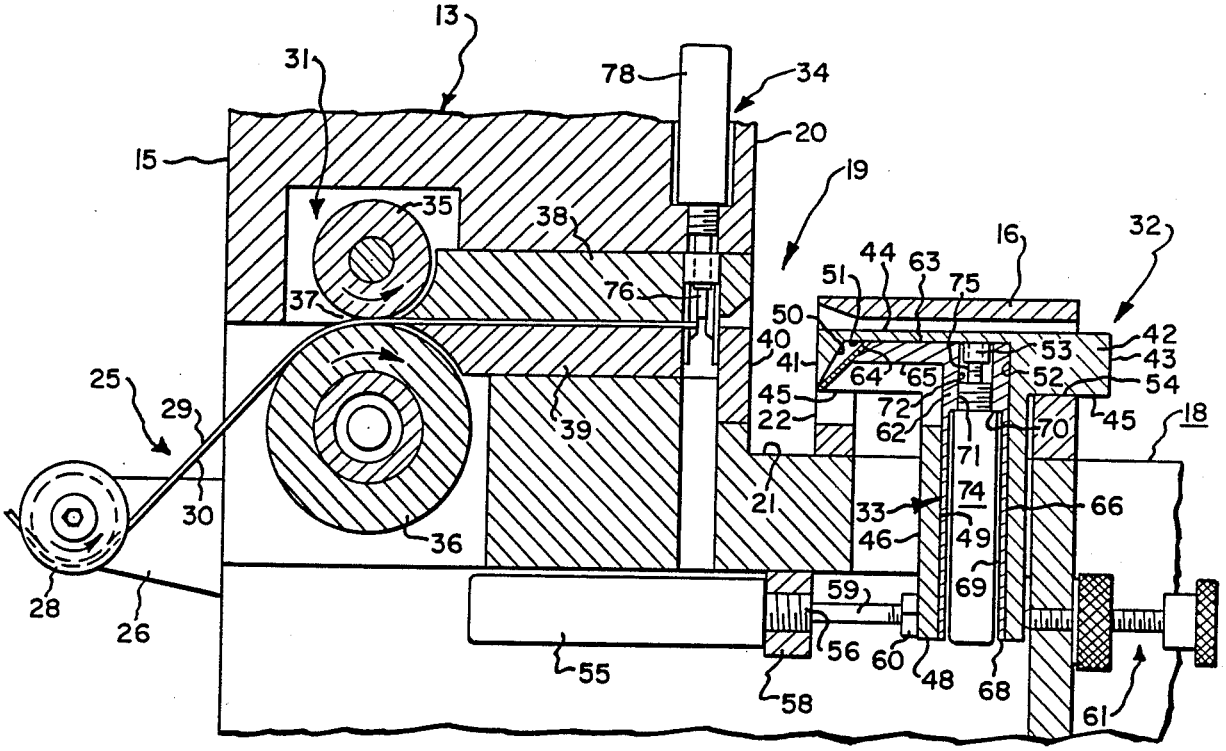

Fig. 8b.
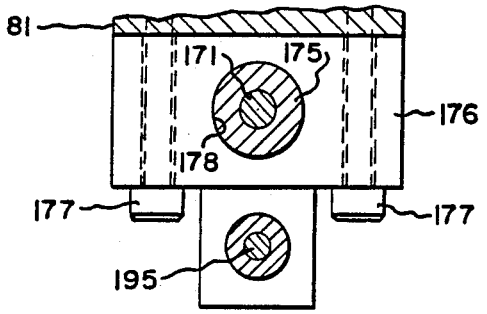
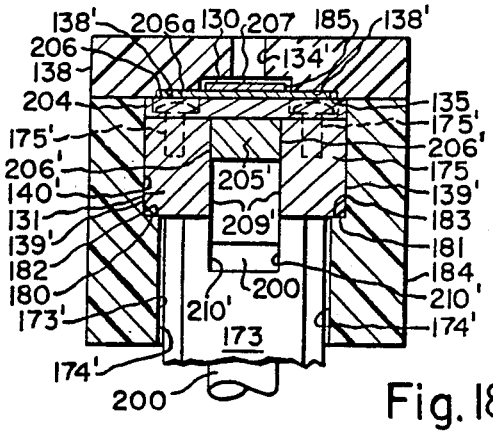
Fig. 18a.
Fig. 10a.
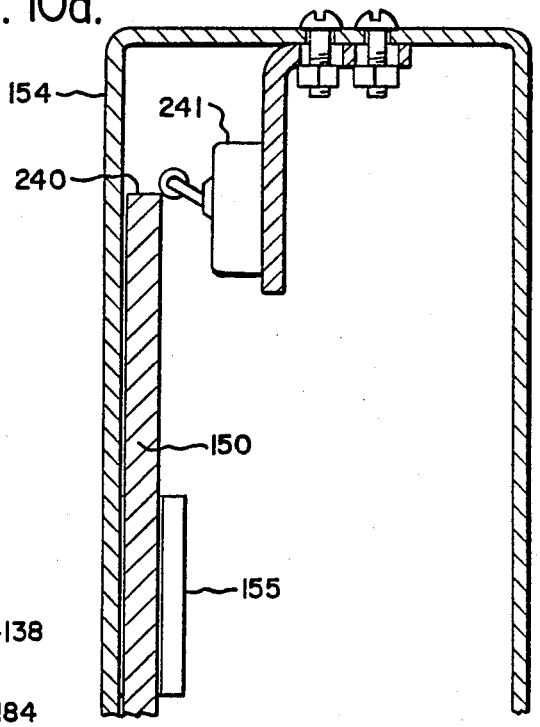
Fig. 10b.
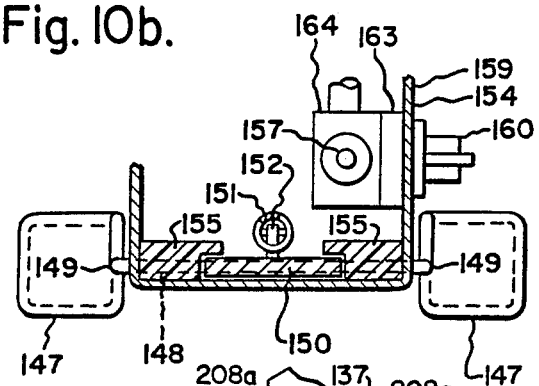
Fig. 14a.
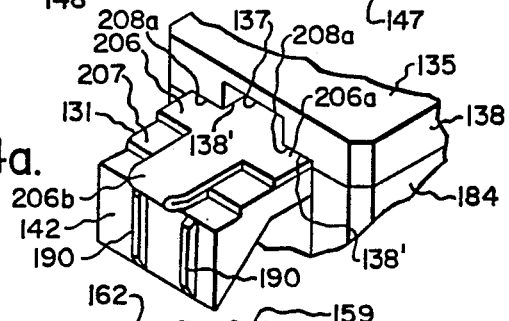
Fig. 12c.
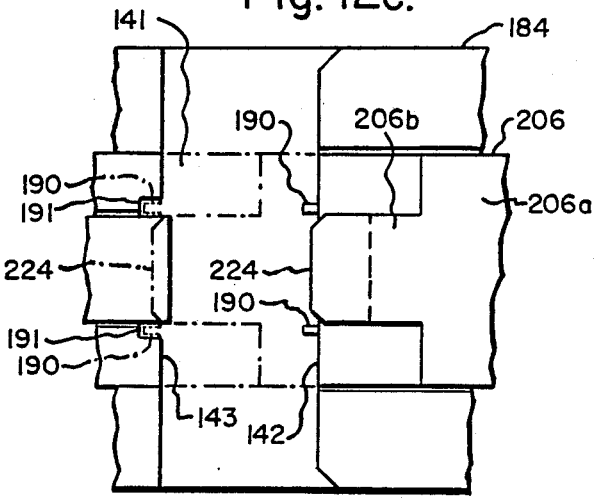
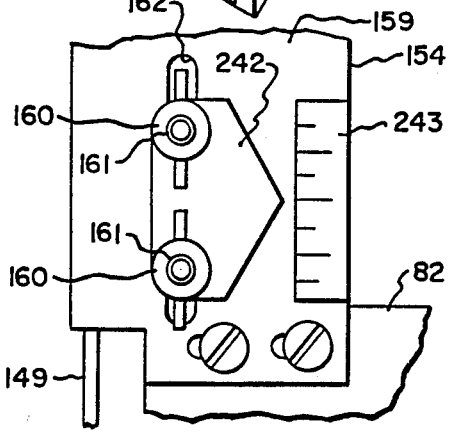
Fig. 10c.

Fig. 18.
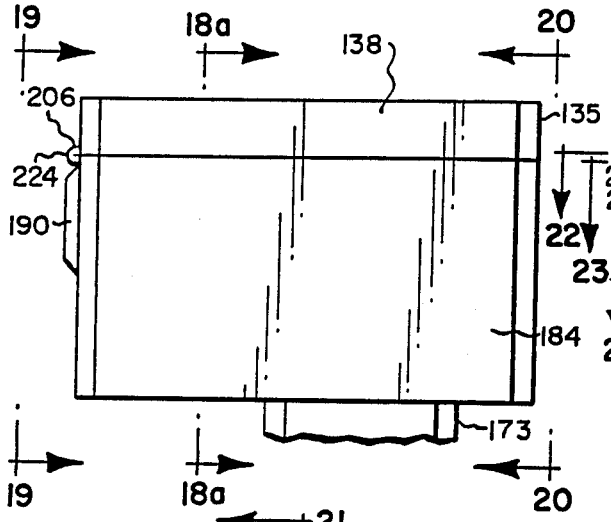
Fig. 21.
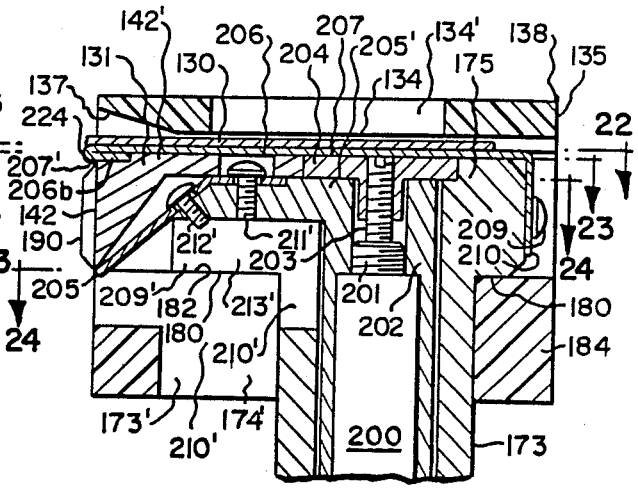
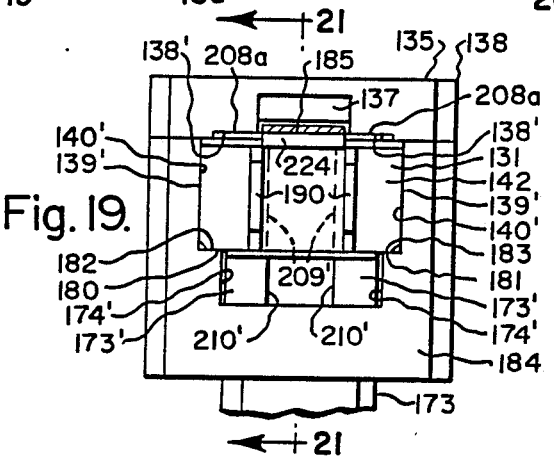
Fig. 19.
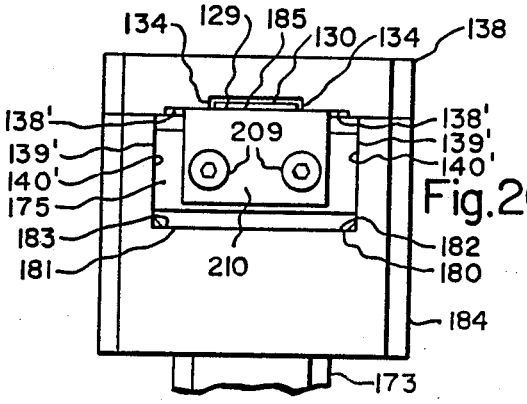
Fig. 20.
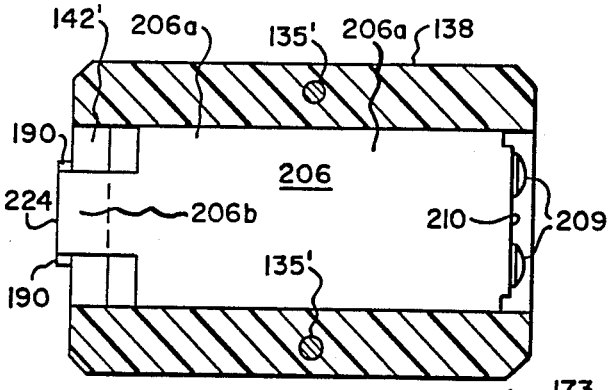
Fig. 22.
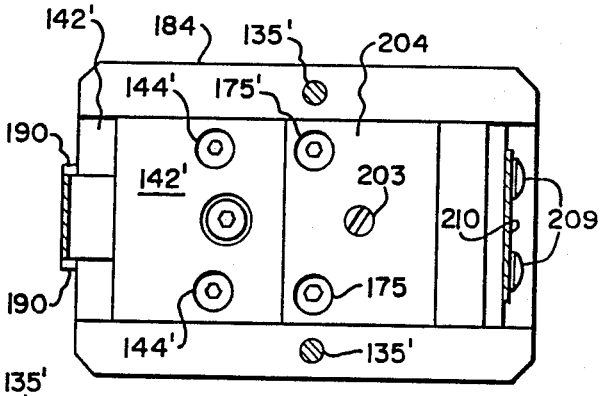
Fig. 23.
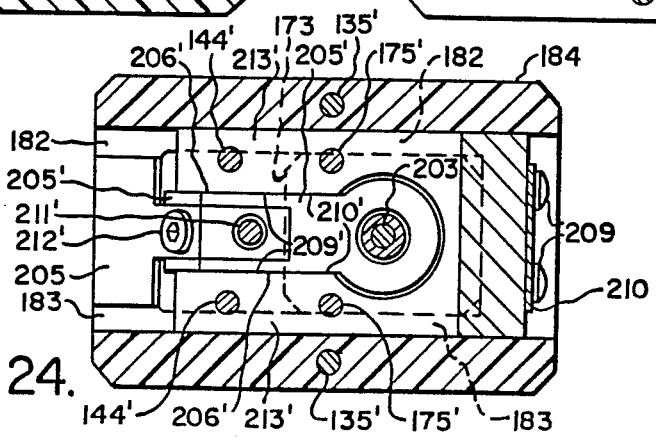
Fig. 24.

METHOD AND APPARATUS FOR HOLDING A PLURALITY OF OBJECTS IN A TAPE-WRAPPED BUNDLE

REFERENCE TO RELATED APPLICATION

The present invention is a continuation-in-part of application Ser. No. 944,430, filed Dec. 18, 1986 now abandoned.

BACKGROUND OF THE INVENTION

The present invention relates generally to the field of devices and mechanisms for holding a plurality of objects together into a tape-wrapped bundle, and more specifically to a method of, and apparatus for, wrapping a plurality of objects together with an adhesive or cohesive tape.

It is often desired to hold a number of objects together in a tightly-wrapped bundle. The objects-to-be-held may take many and varied forms. For example, such objects may be tubular or rod-like articles, or may be a number of adjacent convolutions of a coil of wire, tubing, or the like.

In medical applications, it is common to first wind a length of flexible plastic tubing into a coil, and to thereafter wrap the convolutions with cohesive tape to hold the coil together. Thereafter, the tape-wrapped coiled article may be inserted into a sterilized bag for handling and storage prior to use. Upon information and belief, such tubing is commonly wrapped manually by having an operator wrap the adjacent convolutions with various lengths of adhesive or cohesive tape. This requires unnecessary manual labor, and is extremely tedious for the operator. Furthermore, when a coil of flexible plastic tubing is held by a plurality of bands of adhesive tape each having its leading and trailing end portions adhered to each other in surface-to-surface relationship, it is desirable that all of the edges of these end portions be flush with each other so that they do not pick up foreign matter which can contaminate the tape, especially when the coil is used for medical applications.

SUMMARY OF THE INVENTION

It is one object of the present invention to provide an improved method of wrapping a number of objects with a band of tape.

Another object of the present invention is to provide an improved machine for applying a band of tape to a plurality of objects.

A further object of the present invention is to provide an improved machine for applying a band of tape around a plurality of objects in such a manner that the leading and trailing ends of the tape are caused to adhere to each other in face-to-face relationship with all their edges substantially flush with each other so that the adhesive on the tape will not be contaminated by foreign objects which may adhere thereto. Other objects and attendant advantages of the present invention will readily be perceived hereafter.

The improved apparatus includes: a frame having a recess, the recess having an open mouth and opposed side walls, a quantity of tape having an adhesive or cohesive substance on at least one surface thereof; advance means mounted on the frame and selectively operable to advance a length of tape, with the sticky substance thereon facing away from the recess, across the mouth of the recess so that a leading part of the tape length will be arranged on one side of the recess, an intermediate part will be arranged across the recess, and a trailing part will be arranged on the other side of the recess, such that, when a number of objects to-be-bundled are thereafter inserted downwardly into the recess, the tape length will be pulled back and gathered into the recess with the intermediate part engaging at least some of the objects and with the leading and trailing portions arranged to face one another; pressing means mounted on the frame and operatively arranged to initially press together portions of the leading and trailing tape parts proximate the mouth of the recess; and wiping means mounted for selective movement relative to the pressing means for progressively increasing the length of such pressed-together portions in a direction toward the objects; whereby, the objects will be held in a tape-wrapped bundle. The improved apparatus also includes: cut-off means for selectively severing the length of tape from a larger quantity thereof with the end edges flush with each other; and guide means for causing the edges of the leading and trailing parts to be flush with each other so that no adhesive is exposed which could catch foreign objects. By adjusting the force exerted by the wiping means, the bundle may be wrapped tightly or loosely, as desired.

In use, the improved apparatus performs an improved method of wrapping a plurality of objects with tape having a sticky substance on at least one surface thereof, which method comprises the steps of: positioning a length of tape relative to a recess, with the sticky substance thereon facing away from the recess, such that a leading part of the tape is arranged on one side of the recess, an intermediate part extends across the mouth of the recess, and a trailing part is arranged on the other side of the recess; inserting a plurality of objects-to-be-wrapped into the recess such that the tape length will be gathered into the recess with the intermediate part engaging some of the objects and with the leading and trailing parts arranged to substantially face one another; pressing portions of the leading and trailing tape parts together in the vicinity of the mouth of the recess; and wiping the leading and trailing tape parts in a direction toward the objects to progressively increase the length of such pressed-together portions in a direction toward the objects; thereby to firmly hold the objects together in a tape-wrapped bundle. The method may also include the step of severing the tape length from a larger quantity thereof.

The various aspects of the present invention will be more fully understood when the following portions of the specification are read in conjunction with the following drawings wherein:

BRIEF DESCRIPTION OF THE DRAWINGS

FIG. 1 is a perspective view looking at the right side of the improved apparatus, this view showing the frame, a roll of tape mounted on the frame, the recess, and further showing the objects-to-be-bundled as being a plurality of convolutions of a coiled length of flexible plastic tubing positioned in the bottom of the recess prior to the pressing and wiping operations.

FIG. 2 is a fragmentary schematic vertical sectional view of a pertinent portion of the apparatus shown in FIG. 1, but with the objects removed, this view showing the tape as captured in the nip between the feed rollers, the cut-off mechanism, the first and second jaws, and the wiping mechanism.

FIG. 8*b* is a fragmentary cross sectional view taken substantially along line 8*b*—8*b* of FIG. 8.

FIG. 10*a* is a fragmentary cross sectional view taken substantially along line 10*a*—10*a* of FIG. 10.

FIG. 10*b* is a fragmentary cross sectional view taken substantially along line 10*b*—10*b* of FIG. 10.

FIG. 10*c* is a fragmentary view taken substantially in the direction of arrows 10*c*—10*c* of FIG. 10.

FIG. 12*c* is an enlarged fragmentary plan view taken substantially along line 12—12 of FIG. 8 and showing the movable jaw in both open and closed positions relative to the fixed jaw.

FIG. 14*a* is a fragmentary perspective view of the movable jaw in an extended position for engaging the stationary jaw.

FIG. 18 is a fragmentary side elevational view of the post and the lower portion of the movable jaw.

FIG. 18*a* is a fragmentary cross sectional view taken substantially along line 18*a*—18*a* of FIG. 18.

FIG. 19 is a fragmentary end elevational view taken substantially in the direction of arrows 19—19 of FIG. 18.

FIG. 20 is a fragmentary end elevational view taken substantially in the direction of arrows 20—20 of FIG. 18.

FIG. 21 is a fragmentary cross sectional view taken substantially along line 21—21 of FIG. 19.

FIG. 22 is a cross sectional view taken substantially along line 22—22 of FIG. 21.

FIG. 23 is a cross sectional view taken substantially along line 23—23 of FIG. 21.

FIG. 24 is a cross sectional view taken substantially along line 24—24 of FIG. 21.

DESCRIPTION OF THE PREFERRED EMBODIMENTS

Figure 3:
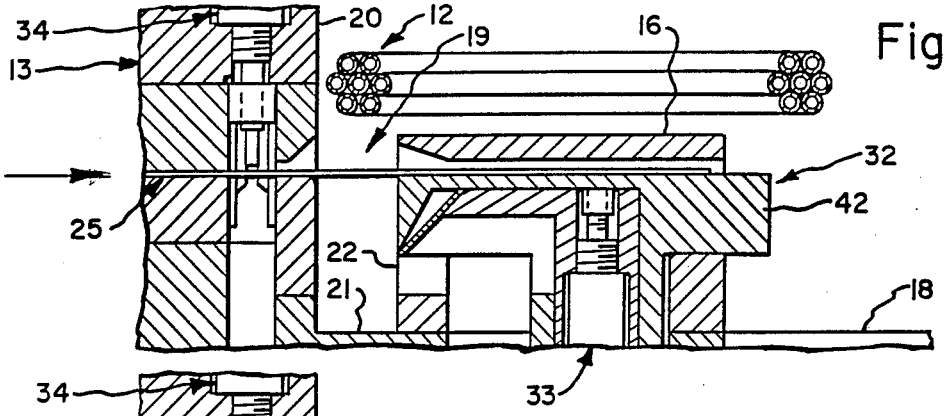
FIG. 3 is a schematic view showing a length of tape as having been advanced across the recess, this view also showing the objects-to-be-bundled as positioned overhead the recess.

At the outset, it should be clearly understood that like reference numerals are intended to identify the same structural elements, portions of surfaces consistently throughout the several drawing figures, as such elements, portions or surfaces may be further described or explained by the entire written specification, of which this detailed description is an integral part. Each embodiment will bear its own numerals. The drawings are intended to be read (e.g., cross-hatching, arrangement of parts, etc.) together with the specification, and are to be considered a portion of the entire written description of this invention. As used in the following description, the terms "horizontal", "vertical", "left", "right", "up" and "down", as well as adjectival and adverbial derivatives thereof (e. g., "horizontally", "rightwardly", "upwardly", etc.) simply refer to the orientation of the illustrated structure as the particular drawing figure faces the reader. Unless otherwise indicated, the terms "inwardly" and "outwardly" refer to the orientation of a surface relative to its axis of elongation, or axis of rotation, as appropriate.

Referring now to the drawings, and more particularly, to FIGS. 1 and 2 thereof, this invention, in one aspect, provides improved apparatus, of which the presently-preferred embodiment is generally indicated at 10, for wrapping a plurality of objects into a bundle.

In the following description, the particular objects are shown as being a number of adjacent convolutions, severally indicated at 11, of a coil of flexible plastic tubing 12, such as commonly used in medical applications. However, it should be clearly understood that this is illustrative only, and is not intended as being limitative of the scope of the appended claims. Indeed, as used herein, the term "object" is intended in a broad generic sense, and the particular tubing convolutions 11 shown are only one species example of such objects. Other examples of such objects include elongated tubes, rod-like articles, and so forth. This list is not intended as being exhaustive of other possible species of such "objects", but as merely amplifying the list of possible objects which may be conveniently bundled by use of the improved apparatus.

In any event, the improved apparatus broadly includes a sectional frame 13 having, in pertinent part, a substantially L-shaped planar vertical right side surface 14, a planar vertical front surface (not fully shown), and a planar vertical back surface 15 (FIG. 2). A hollow rectangular post 16 extends upwardly from the planar horizontal upper shelf surface 18 of the frame's horizontal leg in spaced relation to the frame's upstanding leg so as to define an upwardly-facing transversely extending substantially U-shaped recess, generally indicated at 19, proximate the intersection of the frame's horizontal and vertical leg portions. More particularly, this recess is defined by the forwardly-facing planar vertical surface 20 of the frame's vertical leg portion, a portion 21 of shelf surface 18, and the rearwardly-facing planar vertical surface 22 of the post.

A pair of transversely spaced upper arms, one of which is indicated at 23, extends horizontally outwardly from frame back surface 15. These arms have aligned recesses at their distal ends to receive and accommodate a pivot pin 24 by which a roll of tape 25 may be rotatably mounted on the frame. Another arm 26 extends horizontally outwardly from frame back surface 15 beneath arms 23, 23. At its distal end, arm 26 supports a freely rotatable idler roller 28 about which the unrolled tape passes before entering the frame.

In the preferred embodiment, the tape has a cohesive substance on its upper surface 29, but not on its lower surface 30. As used herein, the term "cohesive" refers to a type of sticky substance which has an affinity to stick to itelf, but a reduced propensity to stick to other objects. This type of substance is well known and is found, for example, on destination tags which airlines apply to a passenger's baggage. However, the invention is not limited to use with such one-sided cohesive tape. For example, the tape could alternatively have an adhesive substance on its upper surface. As used herein, the term "adhesive" refers to a type of sticky substance which will not only adhere to itself, but to many other types of objects as well. Thus, the term "adhesive" refers to a sticky substance generally, and the term "cohesive" refers to a particular type or species of an adhesive substance having the properties indicated above. Hence, the tape may have at least one surface thereof provided with either an adhesive or cohesive sticky substance. This does not necessarily exclude the possibility of using two-sided adhesive or cohesive tape, should this be desired.

Referring now to FIG. 2, the improved apparatus is shown as broadly including advance means, generally indicated at 31, for selectively and controllably advancing a length of tape; pressing means, generally indicated at 32, for selectively pressing together portions of the advanced tape length proximate the mouth of the recess; wiping means, generally indicated at 33, selectively operable to wipe the leading and trailing tape parts into pressed engagement while moving toward the objects, and cut-off means, generally indicated at 34, selectively operable to sever such advanced tape length from the roll.

The advance means 31 is shown, in pertinent part, as including a pair of closely-spaced upper and lower rollers 35, 36 mounted on the frame. The upper roller 35 has a relatively small diameter, and the lower roller 36 has a relatively large diameter. These rollers are positioned such that their outwardly facing cylindrical surfaces are arranged in close proximity to one another so that the unrolled tape will be gripped in the nip 37 therebetween. At least one of these rollers is powered, as by a conventional sprocket and chain arrangement (not shown) connected to a motor (not shown), so that when the powered roller is selectively rotated in the direction of the indicated arrow, the unrolled tape will be advanced from left to right across the open mouth of recess 19. While the other cooperative roller need not be powered, it may be if desired. Persons skilled in this art will appreciate that notwithstanding the difference in their diameters, the surface speeds of these rollers are the same. Thus, when the advance means is operated, the tape is pulled off the roll, passes around intermediate idler roller 28, and is advanced rightwardly between upper and lower guides 38, 39.

The pressing means 32 is shown as including a pair of horizontally spaced opposed left and right jaws 40, 41. The left jaw 40 is mounted on the frame and has a rightwardly facing planar vertical surface arranged so as to be substantially flush with recess left surface 20. The right jaw 41 is mounted on a somewhat T-shaped member 42 having an upper head portion and having a tubular portion depending therefrom.

The head portion is shown as having a horizontally elongated rectangular-like appearance, and has a leftwardly facing annular vertical surface 41 which functions as a jaw, an opposite rearwardly facing vertical surface 43, and planar horizontal upper and lower surfaces 44, 45 extending therebetween. The tubular portion is shown as being formed integrally with the head portion, and has an outwardly facing vertical cylindrical surface 46 extending downwardly from the head portion and terminating in a downwardly facing annular horizontal lower end face 48. The tubular portion also has an inwardly facing vertical cylindrical surface 49 extending upwardly from lower end face 48 to communicate with a recess extending upwardly into the head portion from its lower surface 45. More particularly, this recess is bounded by a downwardly and rightwardly facing inclined planar surface 50 which extends upwardly and rightwardly from the lower margin of jaw 41, a downwardly facing horizontal planar surface 51 extending rightwardly therefrom, and a leftwardly facing vertical surface 52 extending downwardly from the right margin of surface 51 to join inner cylindrical surface 49. A nut 53 is mounted fast, as by welding or the like, to surface 51 so as to be axially aligned with surface 49. To the right of the tubular portion, the head portion lower surface 45 slidably engages an upwardly facing horizontal planar surface 54 of the frame. The sliding contact between surfaces 45, 54 functions to guide horizontal leftward and rightward movement of the T-shaped member 42 relative to the frame.

To effect such movement, a fluid powered double acting actuator 55 is mounted on the frame. This actuator has an externally threaded collar 56 matingly received in a tapped hole provided in a boss 58 depending from the frame. The actuator has a rod 59 which may be selectively extended and retracted relative to the actuator cylinder. The distal end of this rod is externally threaded and is matingly received in a nut 60 suitably secured, again as by welding or the like, to the lower marginal end portion of member 42. An adjustable stop, generally indicated at 61, is mounted on the frame to limit rightward movement of member 42. Thus, when actuator rod 59 is extended, member 42 will move rightwardly relative to the frame until it abuts stop 61, as shown in FIG. 2. In this inoperative out-of-the-way position, member 42 will be substantially concealed within the frame post, with jaw 41 being substantially flush with recess side wall 22. However, when the actuator rod is retracted, member 42 will move leftwardly relative to the frame such that movable jaw 41 will engage stationary jaw 40. The degree of pressing force between these two jaws will be function of the fluid pressure supplied to the appropriate actuator chamber, and the area against which it acts. It may be desirable to provide a suitable means, such as appropriate valving or the like, to afford the capability of varying the amount of such pressing force.

The wiping means 33 includes a wiping member 62 mounted within pressing member 42 for horizontal movement therewith, but mounted for selective vertical movement relative thereto.

Wiping member 62 is shown as being an inverted somewhat L-shaped member having an upper horizontal portion received within the pressing member recess, and as having a dependent tubular portion slidably arranged within the pressing member tubular portion. More particularly, the wiping member has a planar horizontal upper surface 63 arranged to face the pressing member recess surface 51, has an upwardly and leftwardly facing inclined planar surface 64, has a downwardly facing horizontal surface 65, and has an outwardly facing vertical cylindrical surface 66 surrounding the tubular portion and extending downwardly from surface 65 to terminate in a lowermost downwardly facing annular horizontal surface 68. The wiping member is shown as being provided with a stepped vertical through bore coaxial with pressing member surface 49 and nut 53. Specifically, this through bore is shown as being bounded by an inwardly facing vertical cylindrical surface 69 extending upwardly from lower end face 68, a downwardly facing annular horizontal shoulder 70, an internally threaded portion 71, and an inwardly facing vertical cylindrical surface 72 continuing upwardly therefrom to join upper surface 63. A plate-like wiping blade 73 has its upper marginal end portion mounted fast to wiping member surface 64 and extends downwardly and leftwardly therefrom for a purpose hereinafter explained.

An actuator 74 is arranged within the wiping member through bore, and has an externally threaded collar portion matingly engaging through bore threaded surface 71. Thus, the cylinder of the actuator is drawn upwardly into tight abutting engagement with through bore shoulder surface 70. This actuator has a rod 75 which extends upwardly from its cylinder. The distal end of this rod is externally threaded, and is matingly received in nut 53. Actuator 74 is also of the fluid powered double acting type. Hence, when rod 75 is retracted from its cylinder, wiping member 62 moves upwardly relative to pressing member 42 until wiping member upper surface 63 abuts pressing member recess surface 51. Conversely, when the rod of actuator 74 is extended, wiping member 62 moves downwardly relative to pressing member 42. Here again, it may be desirable to provide a means, such as valving or the like, to afford the capability of varying the downward force exerted on the wiping member. This will affect the tightness of the resulting bundle.

The cut-off means 34 is shown as having a guillotine like knife edge 76 associated with another double acting fluid powered actuator 78. The cut-off means is positioned to the left of the recess. Normally, actuator 78 holds the knife edge at an out-of-the-way overhead position. However, actuator 78 may be selectively operated to move the knife edge downwardly so as to sever a length of tape to the right of the knife edge from a quantity of tape to the left thereof. While additional details of the invention are shown in the drawings, these are largely collateral to the invention claimed herein. Hence. a detailed description of such additional features has been omitted.

The operational sequence of the improved apparatus is comparatively illustrated in FIGS. 3–7.

Referring first to FIG. 3, the various actuators are shown as having been operated so that the cut-off blade is in its overhead out-of-the-way position, the pressing member 42 has been moved rightwardly to abut stop 61 and is concealed within the frame post, and the wiping member has been moved upwardly relative to the pressing member so as to abut pressing member recess surface 51. Thereafter, the advance means is operated so as to advance a length of tape across the recess, as shown in FIG. 3. The adhesive surface of this tape faces upwardly and away from the recess. In this condition, a leading part of the advanced tape length is arranged to the right of the recess, an intermediate part spans the open mouth of the recess, and a trailing part is arranged to the left side of the recess. In FIG. 3, the objects-to-be-bundled are arbitrarily depicted as being in a position immediately above the recess, prior to insertion.

Figure 4:
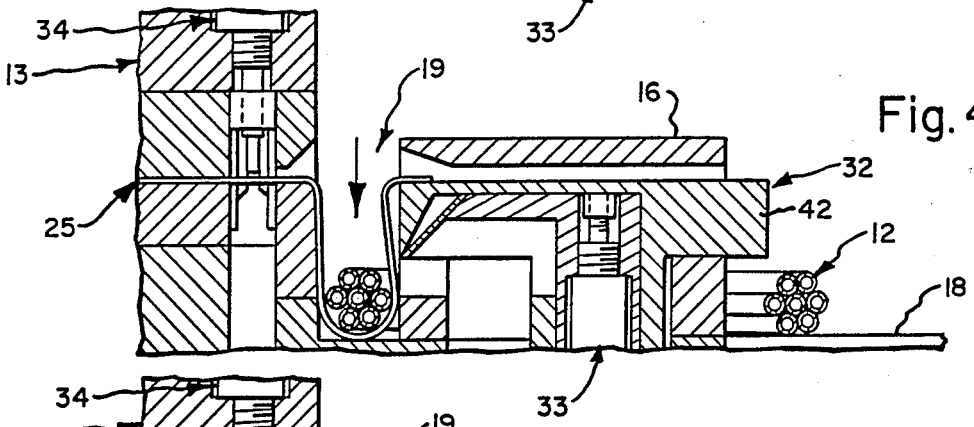
FIG. 4 is a schematic view similar to FIG. 3, but showing the objects as having been moved vertically downwardly, in the direction of the indicated arrow, into the recess so that the tape length will be gathered into the recess with an intermediate part engaging some of the objects and with the leading and trailing tape parts arranged to face one another.

Thereafter, the objects are moved downwardly into the recess, as shown in FIG. 4. Such downward movement causes the tape length to bend and deform, or gather, within the recess such that the intermediate tape part will engage some of the objects, and the leading and trailing tape parts will be arranged within the recess to substantially face one another. During such downward movement of the objects, the frictional engagement between the tape and the now deenergized advance means will prevent additional tape from being pulled from the roll. However, if a one-sided cohesive tape is used, as is presently preferred, the advanced length of tape will be pulled backwardly as it is gathered into the recess.

Figure 5:
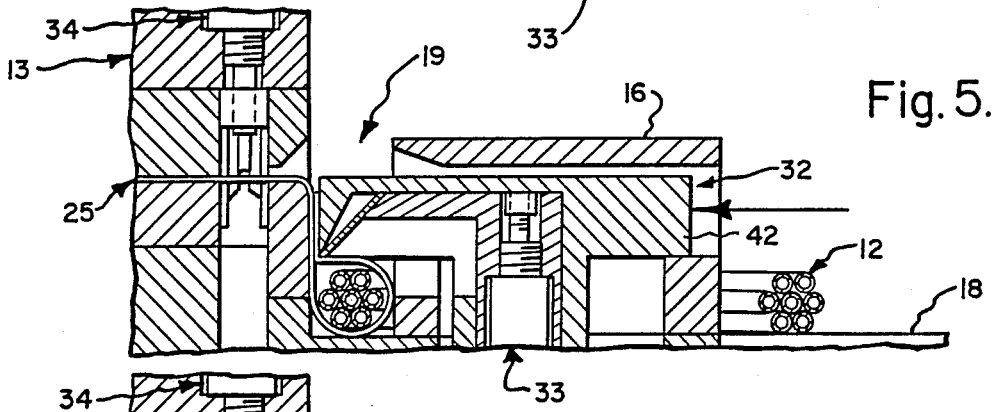
FIG. 5 is a schematic view similar to FIG. 4, but showing the right jaw as having been moved leftwardly, in the direction of the indicated arrow, relative to the stationary left jaw so as to press portions of the leading and trailing tape parts together in the immediate vicinity of the mouth of the recess.

Actuator 55 is then operated to retract its rod 59. This causes the pressing member 42 to move leftwardly so that movable jaw 41 moves toward stationary jaw 40. As shown in FIG. 5, the effect of this is to press together portions of the leading and trailing tape parts in the immediate vicinity of the open mouth of the recess.

Figure 6:
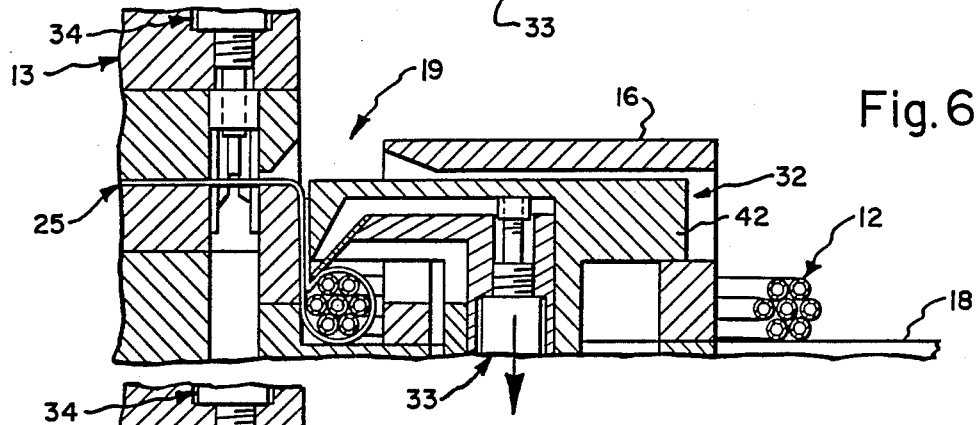
FIG. 6 is a schematic view generally similar to FIG. 5, but showing the wiping blade as having been moved downwardly, in the direction of the indicated arrow, relative to the closed jaws to increase the length of such pressed-together tape portions in a direction toward the objects.
Figure 7:
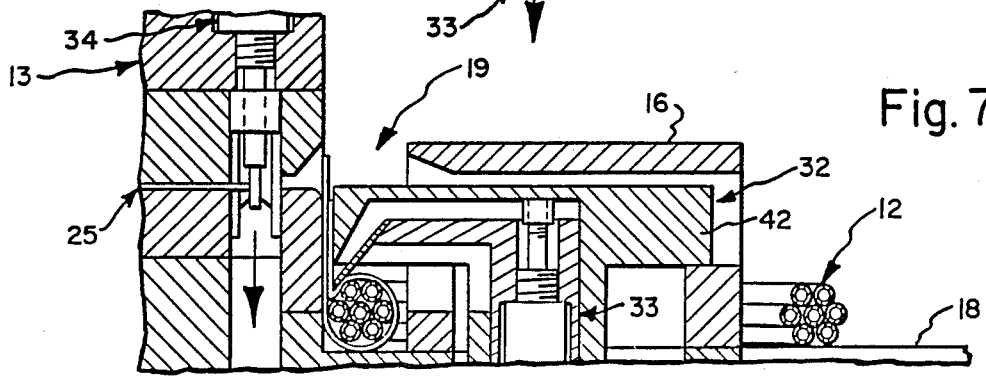
FIG. 7 is a schematic view generally similar to FIG. 6, but showing the cut-off mechanism as having been operated to sever the tape length from the roll.

Actuator 74 is then operated to move the wiping member 62 downwardly relative to the leftwardly displaced pressing member, as shown in FIG. 6. Such wiping blade is already in a leftwardly displaced position and presses the cohesive substances on the leading and trailing tape parts together, while downward movement of the wiping member has the effect of progressively increasing the length of such pressed together portions in a direction toward the objects. Such downward movement continues until the pressing actuator rod either bottoms in its cylinder, or until the wiping blade has compressed the objects into a tightly wrapped bundle, and the upward force exerted on the blade exceeds the downward force exerted by the actuator.

Finally, the cut-off actuator is operated to move the guillotine-like knife blade downwardly to sever such advanced length of tape from the remainder thereof. The tape wrapped objects may be then removed and the various actuators returned to the condition shown in FIG. 3 in preparation for the next sequential operation.

Therefore, in use, the improved apparatus performs an unique method of wrapping a plurality of objects with tape having an adhesive or cohesive substance on at least one surface thereof, which method comprises the steps of: positioning a length of tape across a recess, with the adhesive or cohesive substance thereon facing away from the recess; inserting a plurality of objects-to-be-wrapped into the recess such that the tape length will be gathered into the recess with an intermediate part of this tape length engaging at least some of the objects and with the leading and trailing parts of the tape length arranged to substantially face one another; pressing together portions of the leading and trailing tape parts in the vicinity of the mouth of the recess; and wiping and leading and trailing tape parts in a direction toward the objects to progressively increase the length of such pressed together portions; thereby to hold objects in a tape-wrapped bundle.

Figures 8, 8A:
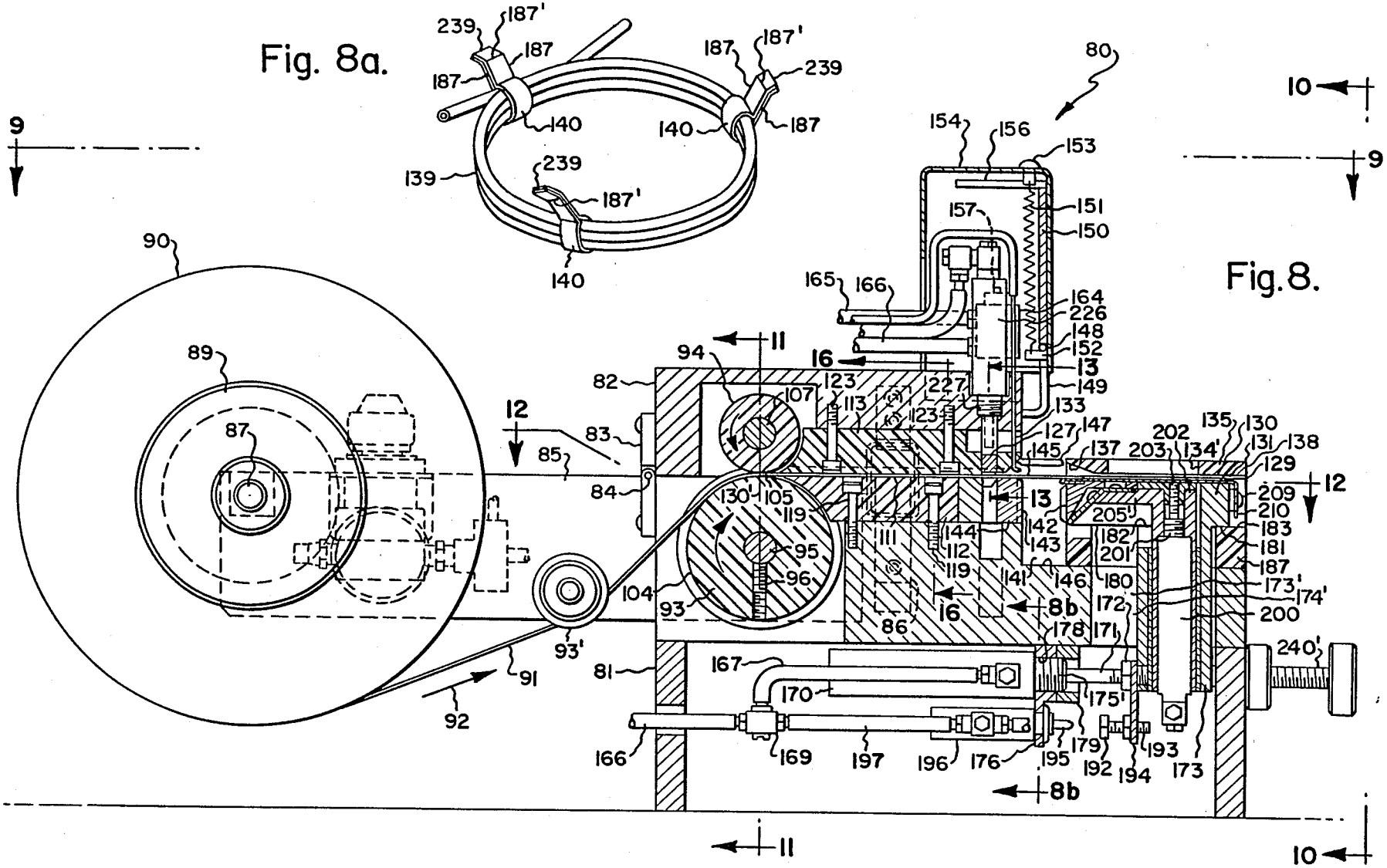
FIG. 8 is a fragmentary cross sectional view of a modified embodiment of the present invention taken substantially along line 8—8 of FIG. 9.
FIG. 8*a* is a perspective view of a coil of tubing having a plurality of tapes circumferentially spaced thereon for holding the coil of tubing in the coiled position shown.

In FIGS. 8–17 a modified embodiment 80 of the present invention is disclosed for producing a banded coil such as shown in FIG. 8*a* and which operates generally in accordance with the principles discussed above relative to FIGS. 1–7 but which has improved structure as described in greater detail hereafter. The machine 80 can also be used to band any elongated articles and is not restricted to banding a coil such as shown in FIG. 8*a*.

After the termination of a single banding operation, as described above relative to FIGS. 1–7, the parts of the machine and the tape 91 are in the positions shown in FIG. 8. In order to have a band of the desired optimum quality, the lapped portions of the tape which adhere to each other, should have their edges in alignment and, further, the cut ends of the tape should be flush with each other. The foregoing orientation of the lapped ends is highly desirable so that there will be no exposed adhesive which can retain contaminating foreign matter. To the foregoing end, an unique tape feeding structure is incorporated into the machine.

The improved tape applicator machine 80 includes a lower frame member 81 having an upper frame member 82 hingedly connected thereto by hinge 83 so that the upper frame member can be swung rearwardly in a counterclockwise direction in FIG. 8 about hinge pin 84 to obtain access to the internal portions of the machine. In the position of FIG. 8, upper frame member 82 is secured to lower frame member 81 by a pair of buckles 86 of the overcenter type.

After a preceding banding operation, wherein a band has been applied to a coil of material, as described above relative to FIGS. 1–7, the tape 91 is advanced to the positions shown in FIGS. 3 and 8. The tape feeding structure includes an arm 85 which extends outwardly of lower frame member 81. A shaft 87 is secured to the outer end of arm 85 for rotatably mounting the core 89 of a roll 90 of tape. The free end portion 91 of the tape is drawn in the direction of arrow 92 about idler roller 93' (FIGS. 8 and 9), and it is guided through the groove 94' of roller 93'. Groove 94' is defined by walls 95' and 96' of roller 93' and by the central portion 97' thereof.

The free end of tape 91 is advanced through the nip between positively driven grooved roller 93 and idler roller 94. Roller 93 (FIGS. 8 and 11) is secured to shaft 95 by set screw 96 and shaft 95 is driven by coupling 97 from the shaft 99 of gear reducer 99' which is driven by motor 100 (FIG. 9) which is located in housing 101. Shaft 95 (FIG. 11) is journalled in bearings 102 and 103 in lower frame member 81. A groove 104 is formed in the outer periphery of driven roller 93 and the outer edge 105 of idler roller 94 fits into groove 104 to press tape portion 91 therebetween. In this respect, idler roller 94 is mounted on shaft 107 which is biased toward roller 93 by springs 109 located in upper frame 82 and compressed by set screws 110 therein to vary the force with which tape 91 is gripped between rollers 93 and 94. Roller 94 includes reduced side portions 108 and washers 108' are located between these shoulders and the sides of frame 82. Thus to this point the free end 91 of the tape is guided in a specifically defined path by the sides of the groove in idler roller 93' and the aligned groove 104 in driven roller 93.

Figure 16:
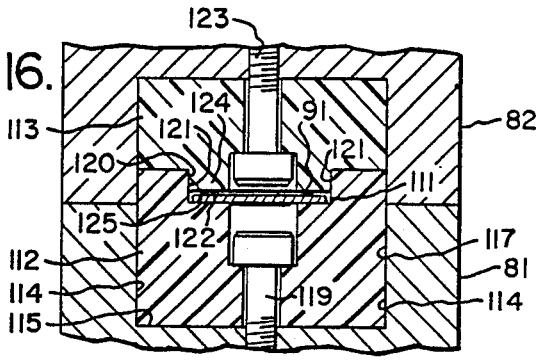
FIG. 16 is a fragmentary cross sectional view taken substantially along line 16—16 of FIG. 8 and showing the relationship between the upper and lower guides for the tape.
Figure 11:
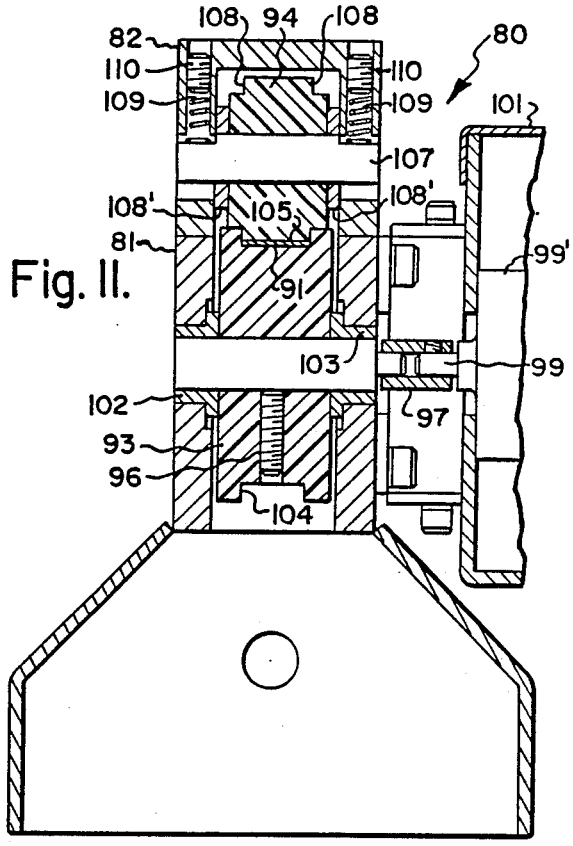
FIG. 11 is a fragmentary cross sectional view taken substantially along line 11—11 of FIG. 8 and showing primarily the relationship between the rollers for advancing the tape.

As it is being moved to the right in FIG. 8 by rollers 93 and 94, the free end 91 of tape 90 is guided through the channel 111 (FIGS. 8 and 16) which is formed between plastic block 112 in lower frame member 81 and plastic block 113 in upper frame member 82. These blocks are fabricated of DELRIN so as to provide a slippery surface to all sides of the channel 111 to enhance the passage of the tape therethrough. Lower block 112 is secured between the sides 114 and bottom 115 of groove 117 in lower frame member 81 by a plurality of screws 119 (FIGS. 8 and 16). Lower block 112 has a groove 120 therein which is defined by sides 121 and bottom 122. Upper block 113, which is secured to upper frame members by screws 123, has a tongue 124 which fits into groove 120 of lower block 112 and the outer edge 125 of tongue 124 is spaced from bottom edge 122 of groove 120. Thus, the channel 111 between blocks 112 and 113 is defined by edges 121, 122 and 125. The channel 111 is in line with the groove 104 in drive roller 93 and the groove 97' in idler roller 93'.

Figure 12:
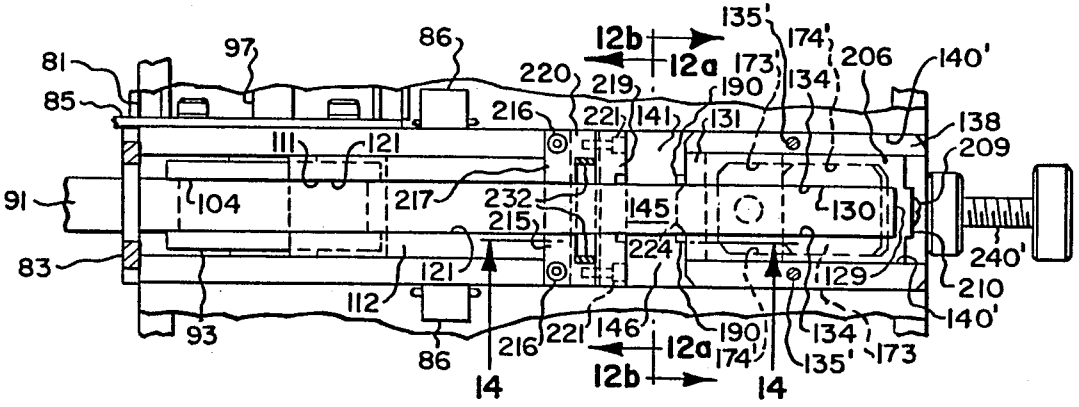
FIG. 12 is a fragmentary cross sectional view taken substantially along line 12—12 of FIG. 8 and showing primarily the guide for the tape and the tongue on the movable jaw for bending the leading end of the tape rearwardly.
Figure 13:
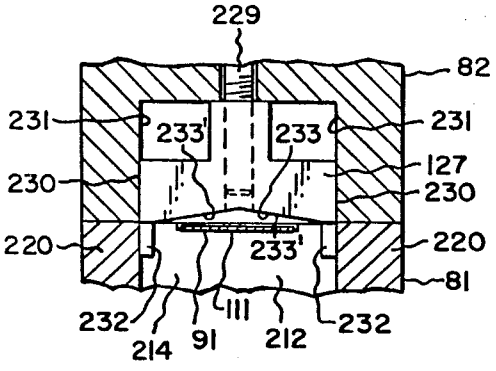
FIG. 13 is a fragmentary cross sectional view taken substantially along line 13—13 of FIG. 8 and showing primarily the configuration of the movable knife and the guide members associated therewith.
Figure 9:
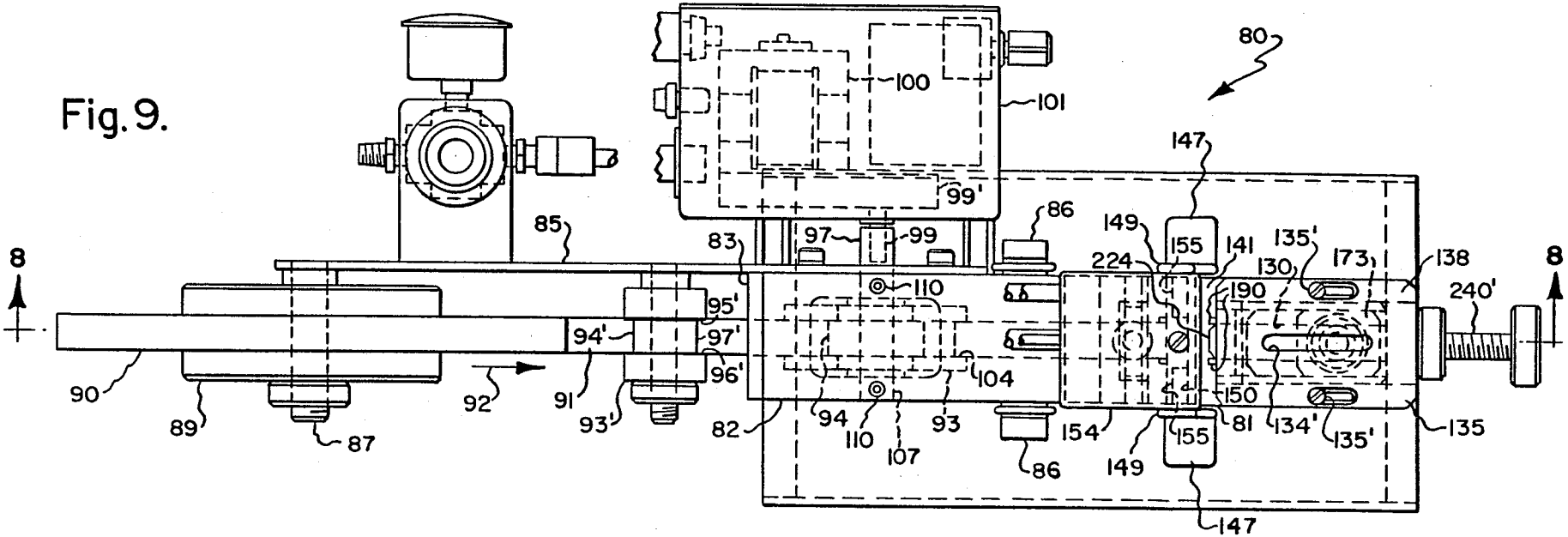
FIG. 9 is a plan view of the machine of FIG. 8 taken substantially in the direction of arrows 9—9 of FIG. 8.
Figure 10:
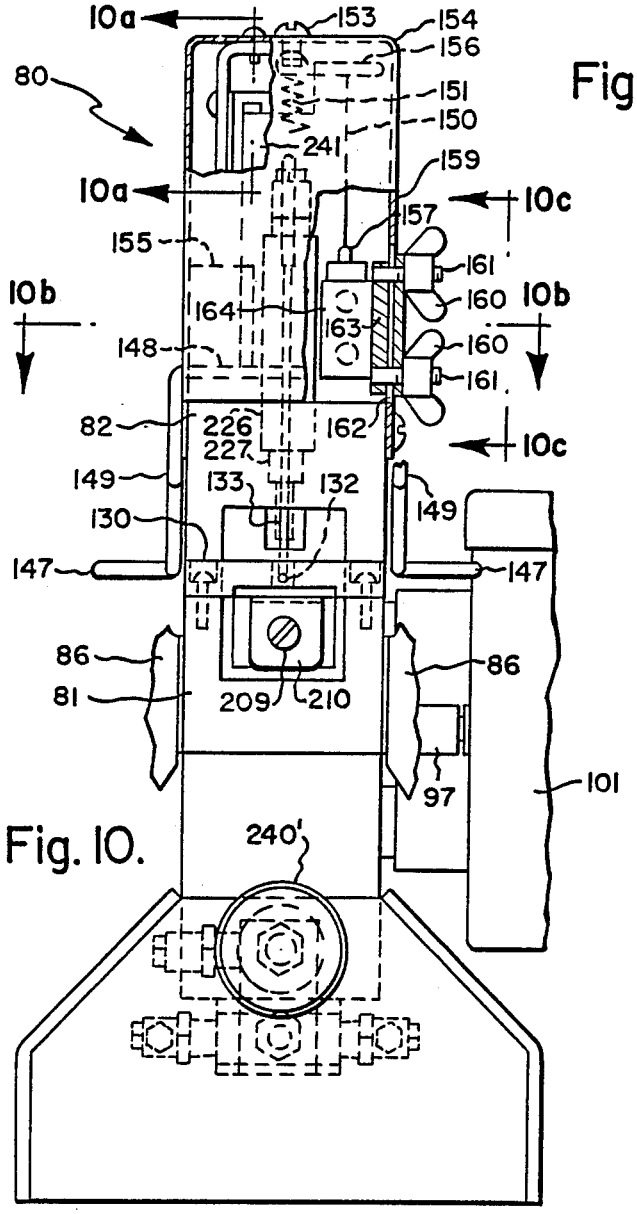
FIG. 10 is a fragmentary end elevational view, partially broken away, taken substantially in the direction of arrows 10—10 of FIG. 8.
Figure 14:
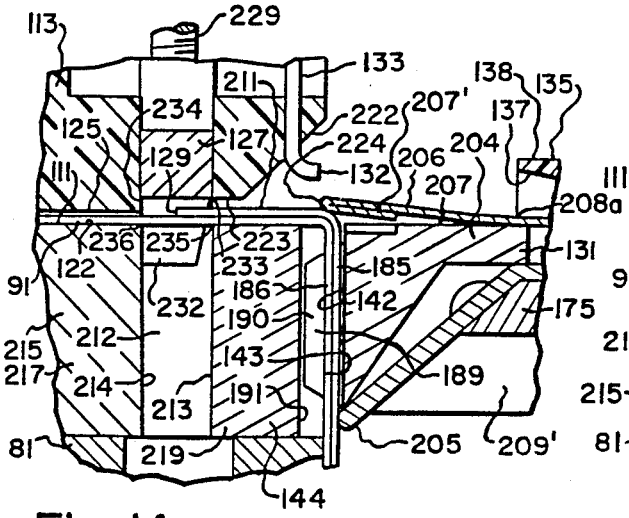
FIG. 14 is a fragmentary enlarged cross sectional view taken substantially along line 14—14 of FIG. 12 showing the movable and stationary jaw portions in a closed position and showing the leading end of the tape bent rearwardly so that its leading edge lies under the movable knife.
Figure 15:
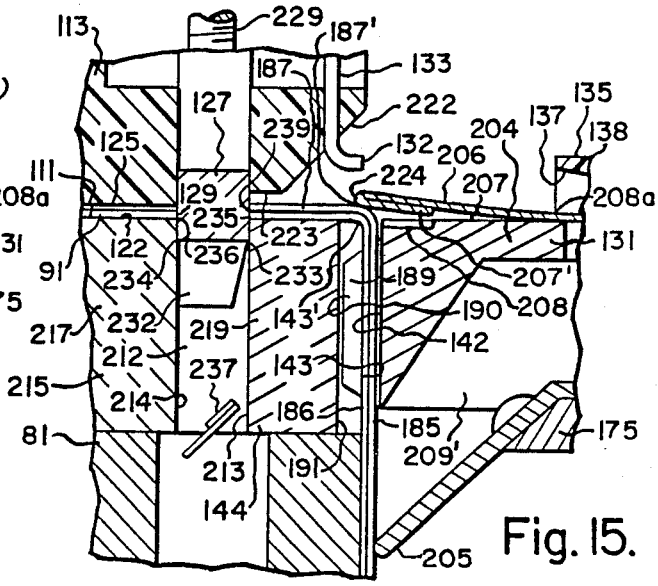
FIG. 15 is a fragmentary cross sectional view similar to FIG. 14 but showing the wiper blade in its lowermost position, and the position of the movable knife after it has sheared the leading and trailing edges of the tape binding the bundle so as to cause them to be flush with each other and after it has severed this tape from the roll to produce a new edge on the following portion, of the tape.

Insofar as pertinent here at the present time, at the end of a preceding banding operation a guillotine type of cutting blade 127 (FIGS. 8, 13, 14 and 15) is actuated to the position of FIG. 15. Normally, however, blade 127 is housed in the retracted position of FIGS. 13 and 14 within upper block 113. When blade 127 is actuated to its cutting position of FIG. 15, one of its functions is to shear the outermost portion of the free end 91 of the tape to provide an extreme outer end 129 (FIG. 15), as described in greater detail hereafter. Thus, at this point the extreme outer end 129 of the free end 91 of the tape is a predetermined distance from the centerline 130' (FIG. 8) extending between the axes of shafts 95 and 107 of rollers 93 and 94, respectively. Motor 100 is thereafter actuated to advance the tape across the open-mouth recess 141 while it is still being guided through channel 111. Motor 100 is of the type A.C. single phase gearhead motor manufactured by Molon Corporation. When motor 100 is energized, it will produce a predetermined number of degrees of rotation of driven roller 93 so that a predetermined length at the free end 91 of the tape will be advanced to the right from the position of the outer end 129 in FIG. 15. The tape will thus be advanced from the position of FIG. 15 to the position shown in FIGS. 3, 8 and 12 wherein its extreme outer end 129 is in channel 130 in post 135. The very outer end 129 of the tape is guided into channel or slot 130 by a constant stream of compressed air blowing downwardly thereon from the outer end 132 of compressed air conduit 133 (FIGS. 8, 14 and 15). A slot 134' is located in the upper plate 138 of post 135 so that the position of the tape within slot 130 can be viewed and possibly manipulated by a suitable instrument if desired. Upper plate 138 is secured to the lower portion of post 135 by screws 135' (FIGS. 9 and 12). Channel 130 has sides 134 (FIGS. 9*a*, 12 and 20) which are in alignment with sides 121 (FIG. 12) of channel 111. Thus, the free end of the tape will be accurately located within the aligned channels 111 and 130. The very outer end 129 of the tape is guided into slot or channel 130 by the beveled edge 137 (FIG. 8) of upper plate 138 of post 135. The tape 91 is extremely thin, approximately 0.003" to 0.005" thick and, by way of example, it may vary in width from about ½" to 1", but it can be wider or narrower. The foregoing channel constructions and compressed air blown on the tape guide this very flexible tape in an extremely positive manner as it moves from the position of FIG. 15 to the position of FIGS. 8 and 9.

With the free end of the tape in the position of FIGS. 8 and 9, a banding action can be initiated. To facilitate the following description, the portion of the tape overlying recess 141 will be considered the central portion of the length of tape which is to become the band 140 (FIG. 8a), and the free end portion 185 of the length of tape to the right of the central portion in channel 130 is to be considered the leading end and the portion 186 to the left of the central portion in channel 111 is to be considered the trailing end of the length of tape.

An unbanded portion of a coil of tubing 139 which is to have tape bands 140 (FIG. 8*a*) applied thereto is forced downwardly onto the central tape portion 145 which extends across the open mouth of recess 141 between the surface 142 (FIG. 8) of movable jaw 131 and the surface 143 of stationary jaw 144 until it bears on bottom wall 146 of the recess. This position is shown in FIG. 4. Surface 142 of the movable jaw is located on part 142' (FIGS. 21 and 23) which is secured to the adjacent spaced legs 213' of the movable jaw by screws 144'. The insertion process actuates the machine to effect an automatic banding operation. In this respect, a portion of a coil of tubing, such as 139 (FIG. 8*a*) without the bands 140 thereon, is pressed downwardly on tabs or gates 147 (FIGS. 8, 9 and 10) which lie on opposite sides of recess 141 and are connected by the central portion 148 of rods 149 to plate 150 (FIGS. 8, 10, 10*a* and 10*b*). A spring 151 extends between a tab 152 on horizontal rod section 148 and an anchor 153 secured to casing 154 mounted on upper frame 82. Plate 150 is guided for vertical rectilinear movement by bearing blocks 155 (FIG. 10*b*) secured to housing 154.

As the portion of the coil which lies between gates 147 is moved downwardly into recess 141, plate 150 will be pulled downwardly with it against the bias of spring 151. When the coil abuts bottom wall 146, horizontal extension 156 (FIG. 8) at the upper end of plate 150 will engage valve stem 157 (FIGS. 8 and 17) of valve 164 which is secured to wall 159 of housing 154 by wing nuts 160 (FIGS. 10 and 10*c*) which thread onto screw stems 161 which extend through slot 162 of wall 159 and are attached to plate 163 on which valve 164 is mounted. By loosening the wing nuts 160 and sliding the stems 161 in slot 162 the position at which the valve 164 is actuated can be adjusted.

When valve stem 157 is actuated, there will be a flow of compressed air from a suitable compressed air source (not shown) through conduit 165 (FIGS. 8 and 17) and valve 164 and into conduit 166 which is in communication with conduit 167 through tee 169. Conduit 167 is in communication with cylinder 170 having piston 171 associated therewith, the outer end of which is threaded into nut 172 which is secured to the lower depending portion 173 of movable jaw 131 (FIGS. 8, 9 and 12). Depending portion 173 is generally rectangular in horizontal cross section (FIGS. 9, 12 and 24) and it is located between and slightly spaced from the sides 174' (FIG. 19) of cutout 173' o (FIGS. 19 and 21) of the post 135. The threaded end 175' of cylinder 170 extends through a bore 178 in plate 176 (FIGS. 8 and 8b) which is attached to the underside of lower frame member 81 by screws 177, and cylinder 170 is secured in position by a nut 179 which is threaded onto threaded end 175'.

It will be appreciated that valve 164 is actuated to actuate cylinder 170 when the central portion of tape 91 is in partial encircling relationship to the coil 139 as is broadly shown in FIG. 4. As the coil 139 is being moved into recess 141, the outer free end of the tape is pulled back from channel 130 to the position shown in FIG. 4 considering that feed roller 93 is now stationary and the free end of the tape in channel 111 to the right of feed roller 93 cannot move to the right. When cylinder 170 is actuated, it remains stationary and the compressed air supplied thereto will cause piston 171 to be pulled to the left in FIG. 8 against the bias of a spring 171' within cylinder 170, and this will move movable jaw 131 to the left. In this respect, the upper head portion 175 of movable jaw 131 has lower surfaces 180 and 181 (FIGS. 19 and 18a) which slide on mating surfaces 182 and 183, respectively, on the central portion 184 of post 135. Furthermore, the upper surface (not numbered) of plate 206 which is affixed to movable jaw 131 and which is described hereafter, will be guided by the adjacent surfaces 138' of top 138 of post 135. The sides 139' of movable jaw 131 will be guided for movement toward and away from the stationary jaw by sides 140' (FIGS. 18*a* and 19) of the post 135.

Figure 12A:
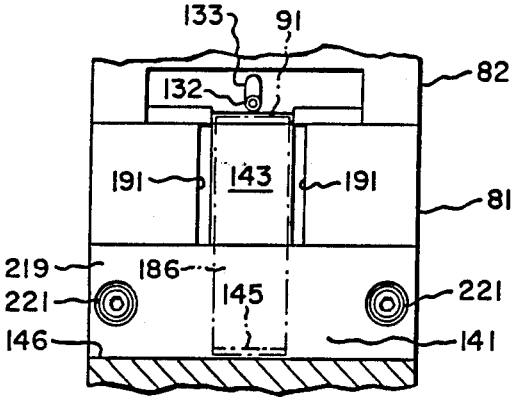
FIG. 12*a* is a fragmentary cross sectional view taken substantially along line 12*a*—12*a* of FIG. 12.
Figure 12B:
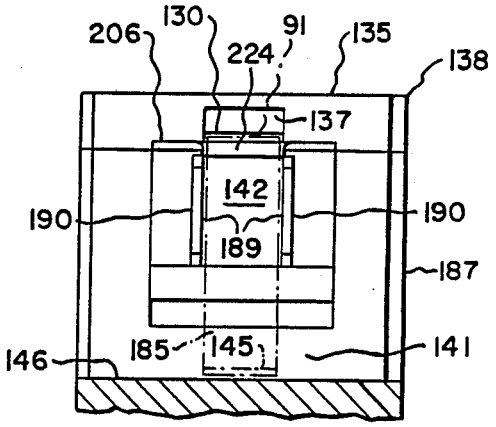
FIG. 12*b* is a fragmentary cross sectional view taken substantially along line 12*b*—12*b* of FIG. 12.
Figure 17:
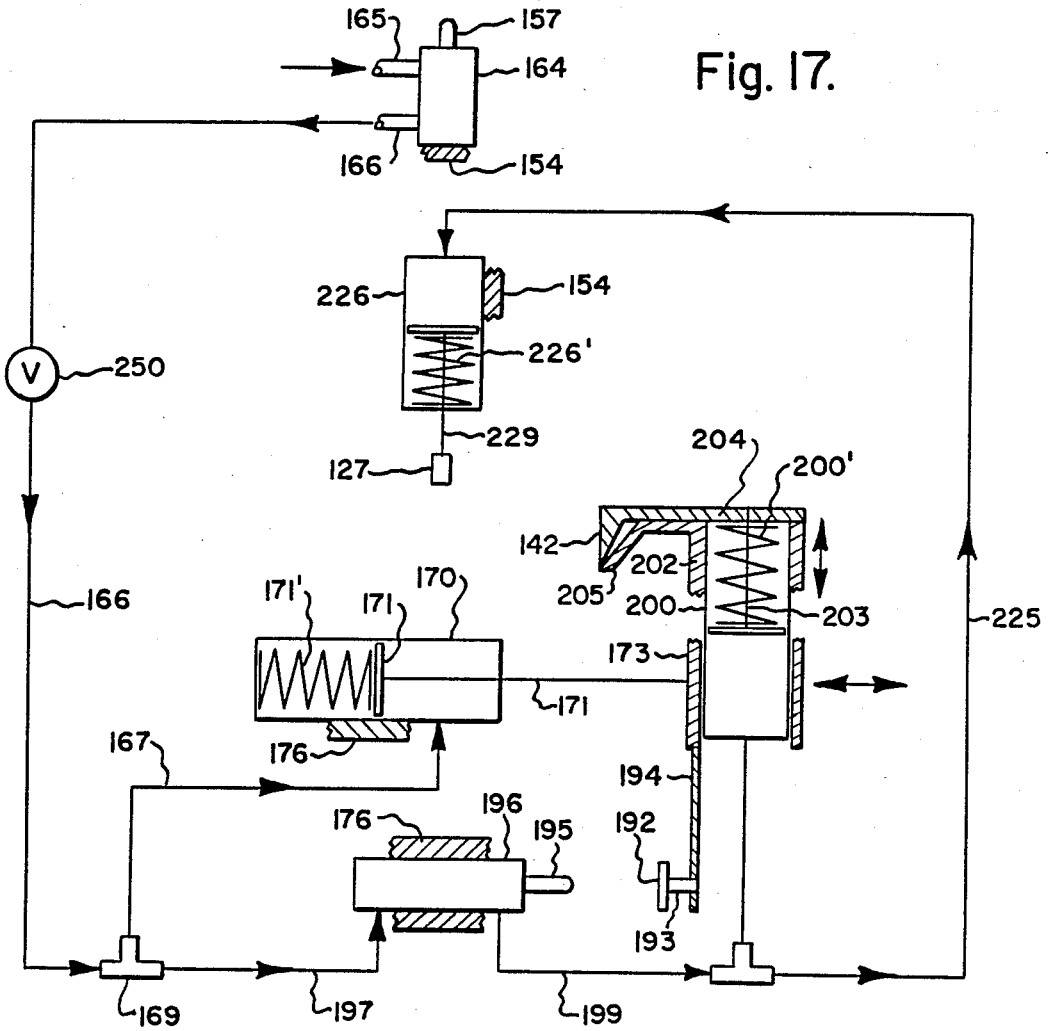
FIG. 17 is a schematic pneumatic diagram for the machine.

As a result of the movement to the left of movable jaw 131, the extreme outer end of the tape will be moved to the position of FIG. 14. In this respect, the surface 142 (FIGS. 8, 12 and 12*b*) of movable jaw 131 will move into contiguous abutting relationship to surface 143 (FIGS. 8, 12, 12*a* and 14) of the stationary jaw with the lapped leading and trailing tape portions 185 and 186 (FIG. 14) therebetween. The side edges 187 of the tape (FIG. 8*a*) will be in perfect alignment with each other for a number ofrreasons. First of all, as the tape is moved from a position of FIG. 4 to a position of FIG. 5, the leading portion of the tape within channel 130 of movable jaw 131 will be guided by the sides of this channel so that it will line up exactly with the trailing portion 186 of the tape which is adjacent the stationary jaw and is in alignment with slot 111. Furthermore, as the leading end portion 185 (FIG. 14) of the tape is pulled downwardly, it will be guided between the sides 189 of elongated ridges 190 (FIGS. 9, 12 and 12*b*) mounted on the face 142 of movable jaw 131. Elongated slots 191 (FIG. 12*a*) are provided in the face of stationary jaw 143 to receive elongated ridges 190, to thereby permit the face 142 of movable jaw 131 to effectively press against the face of stationary jaw 143 with the tape portions 185 and 186 therebetween, to thereby cause the facing adhering portions of the tape to be pressed together with tape portions 185 and 186 having the perfectly aligned edges 187 shown in FIG. 8*a*.

While movable jaw 131 is moving to the left, as described above, the head 192 (FIG. 8) of adjustable screw 193, which is mounted on plate 194 secured to portion 173 of the movable jaw, will engage valve stem 195 of valve 196 secured to plate 176 to thereby permit compressed air to flow from conduit 197 through valve 196 and into conduit 199 which is in communication with cylinder 200 centrally located within lower portion 173 of movable jaw 131. The upper threaded portion 201 of cylinder 200 is threaded into portion 202 of wiper body 205'. Cylinder 200 is vertically slidable in lower portion 173 of movable jaw 131. The piston rod 203 associated with cylinder 200 is threaded into plate 204 of movable jaw 131. Plate 204 is secured to upper head portion 175 of movable jaw 131 by screws 175' (FIGS. 18*a* and 23). Thus when air is admitted to cylinder 200, the cylinder will bodily move downwardly within movable jaw portion 173 against the bias of spring 200' (FIG. 17) and carry wiper body 205' downwardly with it. A wiper blade 205 (FIGS. 14 and 15) is mounted on wiper body 205' by screws 211' and 212', and it will perform the function described above in FIG. 6 in moving from the position of FIG. 5 to the position of FIG. 6. This is also shown in FIGS. 14 and 15 wherein the wiper 205 moves from the position of FIG. 14 to the position of FIG. 15 to cause the lowermost parts of tape portions 185 and 186 to be pressed together, to thereby tighten the tape band 140 about the coil. When the wiper body 205' is moved downwardly to the position of FIG. 15, its sides 206' (FIG. 24) are guided for vertical movement by vertical sides 209' of spaced legs 213' of movable jaw 131 and spaced sides 210' of lower portion 173 of movable jaw 131.

Immediately before the above described wiping, the extreme outer end of the leading portion of the tape is bent rearwardly to the position of FIG. 14 in the later stages of movement of the movable jaw 131. In this respect, a tongue plate 206 (FIGS. 18*a*, 14, 15, 21 and 22) is held against the surface 207 of the movable jaw by screws 209 which are secured to tab 210 (FIGS. 8 and 20). As the movable jaw 131 moves into the position of FIG. 14, the extreme outer end portion 211 of the leading end 185 of the tape is moved to the position shown in FIG. 14 with its extreme end lying across the top of vertical chute 212 which is located between the sides 213 and 214 of stationary knife blade 215 which is secured to plastic block 112 by screws 216 (FIG. 12). In this respect, screws 216 extend through the corners of U-shaped member 217 having the stationary knife blade 215 formed thereon and a plate 219 is secured to the legs 220 of U-shaped member 217 by screws 221 (FIG. 12*a*), plate 219 having on one side the face 143 of the stationary jaw and having on its opposite side the stationary knife blade 15. It is to be noted that there is a beveled face 222 (FIGS. 14 and 15) on block 113 fastened to the upper frame member so as to permit the extreme end portion of the leading end to enter the channel 223 more easily as it is bent to the left in FIG. 14 by the end 224 of tongue 206.

The folding over of the leading and trailing ends 185 and 186 to the position of FIG. 14 is due to the action of tongue plate 206, which includes a broad portion 206*a* and a narrow end portion 206b. Tongue plate 206 is flexible and resilient, and it normally lies flat against surface 207 with the underside 207' of its folded over end portion 206b lying in recess 208 (FIG. 15) in movable jaw 131. The extreme end portion 224 of tongue plate 206 extends outwardly beyond face 142 of the movable jaw an amount which is substantially equal to the amount which ridges 190 extend beyond face 142 so that this extreme end portion of the tongue overlies the edge of the stationary jaw when the jaws are closed. Furthermore, there is an interference fit between the underside of the projecting end of tongue plate 206 and the upper side of the fixed jaw by an amount equal to the thickness of the folded-under portion of the tongue portion 206*b*. Thus the extreme outer end of tongue portion 206*b* will ride up onto the stationary jaw because it is flexible and resilient, as depicted in FIGS. 14 and 15. The folded end of the tongue rides up onto the stationary jaw 143 by passing over the leading end 185 and trailing end 186 of the tape which are bent around the curved corner 143' of the stationary jaw. In this respect the end 224 of the tongue is rounded and the corner 143' is rounded so that this riding up of the tongue 206 to the position of FIGS. 14 and 15 is possible. The tape is extremely thin, on the order of 0.003 to 0.005 inches, and the leading and trailing ends of the tape are squeezed between the underside of tongue portion 206*b* and the top of stationary jaw 143. The tip 224 of tongue plate 206 can ride up to the position of FIGS. 14 and 15 because the tongue is flexible and resilient and is fastened to the movable jaw only at its extreme right end (FIG. 8) by screws 209, as described above. Normally tongue plate 206 lies flat against surface 207 (FIG. 14) when it is not flexed to the position of FIG. 14. When the tongue plate 206 is flexed to the position of FIG. 14, the flexing occurs about corners 208*a* (FIGS. 14*a*, 15 and 19) of post top 135. It is the squeezing of the tape ends 185 and 186 by the foregoing action which forms the bends 187' at the ends of the tapes, as shown in FIG. 8*a*.

The lapped portions of the tape reach the position of FIG. 14 before they are severed. In this respect, as can be seen from FIG. 17, a conduit 225 is in communication with conduit 199 leading from air valve 196, and conduit 225 is in communication with cylinder 226 within housing 154. In this respect, the bottom end of cylinder 226 is threaded at 227 (FIG. 8) and is threadably received in upper frame member 82. A piston 229 (FIG. 14) extends outwardly from cylinder 226 and threadably mounts guillotine knife blade 127 which has outer side edges 230 (FIG. 13) in sliding engagement with the sides 231 of frame 82. The lower ends of the blade are formed into protuberances 232 which are received in chute 212 (FIGS. 13, 14 and 15). The guillotine blade has knife edges 233 and 234. Edge 233 (FIG. 13) has two surfaces 233' which are inclined to each other. Edge 234 is shaped the same way. Edges 233 and 234 coact with stationary knife edges 235 and 236, respectively, of stationary knife 217. Thus when cylinder 226 is actuated, piston 229 will move movable blade 127 downwardly from the position of FIG. 14 to the position of FIG. 15 to thereby shear the end portion 237 (FIG. 15) from the lapped ends of the tape to thereby provide an extremely flush end 239 (FIG. 15) to the lapped tape which bands the bundle and also provides a new edge 129 (FIG. 15) on the portion of the tape coming from the roll.

All of the above-discussed cylinders 170, 200 and 226 remain in their actuated positions while tabs or gates 147 are depressed. When the pressure on these tabs is released after the bundle is lifted from recess 141, the spring 151 will pull plate 150 back to the position shown in FIG. 8 to thus permit valve plunger 157 to be released which shuts off the air from conduit 165 and permits conduit 166 to be vented which in turn permits the spring 171' in cylinder 170 to return piston 171 to the position shown in FIG. 8. This in turn causes the plunger 195 of valve 196 to return to the position shown in FIG. 8 to permit valve 196 to be vented which in turn permits cylinders 226 and 200 to be vented so that the springs 226' and 200', respectively, therein return their associated pistons to the positions shown in FIG. 8. The guillotine knife will return to the position of FIG. 14 from the position of FIG. 15, and the movable jaw will return to the position of FIG. 8 and its limit of movement to the right will be determined by the position of adjusting screw 240'.

As gates 147 return to the position of FIG. 8, plate 150 will return to the position shown therein, and in so doing the upper edge 240 (FIG. 10a) will contact limit switch 241 which energizes motor 100 to cause the gear reducer 99' to produce the required number of degrees of operation to advance the tape to the position shown in FIG. 8.

The foregoing description has described the operation of the pneumatic circuit without miniature pulse valve 250 (FIG. 17) in conduit 166. However, it is preferable that a miniature pulse valve 250 be in the circuit to cause the machine to provide a complete single cycle of operation, as described above, each time that valve 164 is actuated. A miniature pulse valve which has been found satisfactory is known as the CLIPPARD MINIMATIC, Model PV-1. It is a normally open 3-way valve that closes shortly after being pressurized and remains closed until supply pressure is exhausted. It functions to convert a continuous supply of inlet air into a pulse of approximately 100 milliseconds, and, once actuated, it cannot be actuated again until after valve 164 is deactuated by the raising of valve stem 157 in response to the lifting of gates 147.

After one taped band 140 has been wrapped about the bundle in the above-described manner, it is merely necessary for the operator to rotate the bundle the required number of degrees in this instance 120° (FIG. 8*a*), and thereafter depress gates 147 in the above-described manner to effect another tape wrapping and cutting cycle, and when the gates are raised, in the above-described manner, the machine will be reset and thereafter the bundle can be rotated again another 120° to apply yet another band of tape thereto to produce the taped coil shown in FIG. 8*a*.

The machine is adjustabe for different sizes of bundles by the use of adjusting screw 240' (FIG. 8). In this respect, the positioning of the adjusting screw, as shown in FIG. 8, provides substantially the maximum spacing between the fixed and movable jaws. However, if adjusting screw 240' is threaded into the frame, it will move the movable jaw 131 to the left to thereby narrow the recess 141 so that it will be adjusted for narrower tape bundles. In addition, valve 164 can be adjusted vertically by loosening wing nuts 160 and moving stems 161 in slot 162 to an adjusted position. A plate 242 is mounted on stems 161 and points at a calibration scale 243 mounted on casing 154. This will adjust the point at which the pneumatic system is actuated in tee above described manner. Furthermore, for certain very narrow coils, it is contemplated that a shim of proper thickness can be mounted on bottom wall 146. In addition to the foregoing a suitable adjusting mechanism (not shown) is associated with motor 100 for adjusting the length of tape which is fed thereby. Furthermore, the various blocks which form the channels through which the tape travels are replaceable so as to permit different width tapes to be used in the machine.

While the presently preferred embodiment of the improved apparatus has been shown and described, it is contemplated that various changes and modifications may be made. For example, the frame may be of abbreviated or more complicated construction, as desired. The tape may have an adhesive or cohesive substance on one or both sides thereof. However, the use of one-sided cohesive tape is preferred because it tends to permit relative movement between the objects and the tape when the advanced tape length is gathered into the recess. Moreover, the use of cohesive tape tends to prevent the advanced tape length from sticking to the frame.

Other types of advance means may be substituted for that shown and described. Similarly, other types of pressing means and wiping means may be substituted for the specific forms shown and described. While, in the preferred embodiment, one jaw moves relative to the other stationary jaw, such jaws could, if desired, be mutually movable toward and away from one another. Similarly, the wiping means may incorporate a roller or the like to engage the tape, in lieu of wiping blade 205. Thus, the pressing means and the wiping means shown in the drawings, and described herein, are only species examples of what such terms, as used in the claims, are generically intended to cover.

The actuators may be fluid-powered, as shown and described. Thus, the actuators may be either hydraulic or pneumatic. However, the invention is not limited to use with fluid-powered actuators. Indeed, other types of actuators, such as motors and the like, may be readily substituted therefor.

While preferred embodiments of the present invention have been disclosed, it will be appreciated that it is not limited thereto but may be otherwise embodied within the scope of the following claims.

What is claimed is:

1. A method of wrapping a plurality of objects with tape having an adhesive on one surface thereof, comprising the steps of: positioning a length of said tape across a recess, with the adhesive thereon facing away from said recess; inserting a plurality of objects-to-be-wrapped into said recess such that said tape length will be gathered into said recess with an intermediate part of said tape engaging at least some of said objects and with the leading and trailing parts of said tape length arranged to substantially face one another within said recess; pressing first portions of said facing portions of said leading and trailing tape parts together to cause them to adhere to each other in face-to-face relationship within said recess; and wiping second portions of said facing portions of said leading and trailing tape parts in a direction toward said objects, to progressively increase the length of such pressed-together adhered portions toward said objects; thereby to hold said objects together in a tape-wrapped bundle.

2. The method as set forth in claim 1 and comprising the further step of: severing said tape length from a larger quantity thereof.

3. A machine for wrapping a bundle of objects with the central portion of a length of adhesive tape having an adhesive surface on one side thereof and causing the end portions of said adhesive tape on opposite sides of said central portion to adhere to each other in face-to-face relationship to maintain said bundle of elongated objects in a wrapped condition comprising a frame, a recess in said frame, a side wall on one side of said recess, a bottom wall at the bottom of said recess, open mouth means in said recess for underlying said central portion of said length of adhesive tape with said adhesive surface facing away from said recess whereby when said bundle of elongated objects is placed on said surface of said central portion of said length of adhesive tape and moved toward said bottom wall of said recess said central portion will wrap around a portion of said bundle of elongated objects and said surfaces on said end portions of said adhesive tape will be oriented in facing relationship to each other within said recess, pressing means on said frame located in spaced opposition to said side wall, motor means for selectively moving said pressing means toward said side wall to thereby move the facing surface on one of said end portions into engagement with the facing surface on the end portion which is proximate said side wall by pressing said facing end portions between said pressing means and said side wall to thereby adhesively join said facing surfaces on each of said end portions of said length of adhesive tape to each other to thereby produce a wrap around said bundle of elongated objects, and wiping means proximate said recess located in opposition to said side wall and oriented between said pressing means and said bottom wall for wiping across said facing end portions toward said bottom wall below said pressed adhesively joined end portions to thereby further adhesively secure said facing end portions to each other to increase the length of said adhesively joined end portions and thus tighten said wrap around said bundle of elongated objects.

4. A machine as set forth in claim 3 including means on said machine for mounting a roll of adhesive tape from which said length of said adhesive tape which wraps said bundle is taken, and cut-off means on said machine for severing said length of adhesive tape from said roll.

5. A machine as set forth in claim 3 wherein said pressing means includes a portion which constitutes a second side wall of said recess in opposition to said side wall.

6. A machine as set forth in claim 3 including post means on said frame spaced from said side wall, and means on said post means for slidably mounting said pressing means for movement toward said side wall upon actuation of said motor means.

7. A machine as set forth in claim 6 including mounting means for mounting said wiping means for movement with said pressing means during slidable movement of said pressing means, and second motor means for causing said wiping means to wipe across said adhesively joined portions.

8. A machine as set forth in claim 7 wherein said means for mounting said pressing means comprises a substantially T-shaped member having a horizontal top and a vertical leg, and wherein said means for mounting said pressing means slidably mounts said horizontal top, and wherein said second motor means is mounted in said vertical leg.

9. A machine as set forth in claim 6 including means on said machine for mounting a roll of adhesive tape from which said length of said adhesive tape which wraps said bundle is taken, and cut-off means on said machine for severing said length of adhesive tape from said roll.

10. A machine as set forth in claim 7 including means on said machine for mounting a roll of adhesive tape from which said length of said adhesive tape which wraps said bundle is taken, and cut-off means on said machine for severing said length of adhesive tape from said roll.

11. A machine as set forth in claim 8 including means on said machine for mounting a roll of adhesive tape from which said length of said adhesive tape which wraps said bundle is taken, and cut-off means on said machine for severing said length of adhesive tape from said roll.

12. A machine for wrapping a bundle of objects with the central portion of a length of tape taken from a roll of tape, said length of tape having opposite side edge portions and a free leading end portion and a trailing end portion on opposite sides of said central portion, said length of tape having an adhesive surface on one surface thereof, and said machine causing said free leading end portion and said trailing end portion to adhere to each other in surface-to-surface relationship while said trailing end portion remains attached to said roll of tape to hold said bundle of objects in a wrapped condition comprising a frame, means on said frame for mounting said roll of tape, a recess in said frame, means on said frame for advancing said free leading end portion of said length of tape across said recess to cause a portion of said length of tape to lie in overlying relationship to said recess while maintaining said length of tape attached to said roll with said adhesive surface facing away from said recess, a stationary jaw on one side of said recess, a movable jaw on the opposite side of said recess from said stationary jaw, means for moving said movable jaw toward said stationary jaw after said central portion of said tape is forced into said recess by said bundle while said length of tape remains attached to said roll of tape to thereby move said leading and trailing end portions toward each other to cause said upper surfaces thereof to adhere to each other in said surface-to-surface relationship, guide means on said frame for engaging said opposite side edge portions and guiding said free leading end of said length of tape in a predetermined path when said length of tape is being advanced across said recess and for causing corresponding side edge portions of said free leading end portion and said trailing end portion to be in substantial alignment after said movable jaw has moved toward said stationary jaw to cause said upper surfaces of said leading and trailing end portions to adhere to each other and cause said corresponding side edge portions of said leading and trailing end portions to be substantially flush with each other after they have adhered to each other and while said length of tape remains attached to said roll, and trimming mean for trimming the outer ends of said leading and trailing end portions after said leading and trailing end portions have been adhered to each other with their side edge portions flush with each other to cause said outer trimmed ends to be substantially flush with each other.

13. A machine for wrapping a bundle of objects as set forth on claim 39 wherein said guide means on said frame include first channel means on said one side of said recess, and second channel means on said opposite side of said recess.

14. A machine for wrapping a bundle of objects as set forth in claim 13 wherein said guide means include means separate from said first and second channel means and located on said one side of said recess for guiding said leading end portion from said first channel means into said second channel means as said tape is being advanced across said recess when said movable jaw is spaced from said stationary jaw.

15. A machine for wrapping a bundle of objects as set forth as claim 14 wherein said last-mentioned means comprises an air jet which directs a stream of air downwardly onto said upper surface of said tape as it travels across said recess.

16. A machine for wrapping a bundle of objects as set forth in claim 13 including third channel means on said movable jaw in axial alignment with said first and second channel means for guiding said leading end portion of said tape into alignment with said trailing end portion with said opposite edge portions in substantial alignment as said movable jaw moves toward said stationary jaw, said third channel means comprising spaced elongated ridges on said movable jaw for engaging and guiding said side edge portions of said leading end portion as it is being drawn into said depression.

17. A machine for wrapping a bundle of objects as set forth in claim 12 including second trimming means spaced from said trimming means toward said roll of tape for trimming the extreme end portion of the leading end portion of a subsequent predetermined length of tape prior to advancing said subsequent predetermined length of tape in overlying relationship to said recess.

18. A machine for wrapping a bundle of objects as set forth in claim 12 wherein said means include knife means in said frame, and moving means for moving the extreme outer end of said leading end portion which is not adhered to said trailing end portion into overlying relationship with said trailing end portion in the path of said knife means.

19. A machine for wrapping a bundle of objects as set forth in claim 18 wherein said moving means comprises protuberance means on said movable jaw for bending a portion of said leading end portion which is remote from said central portion in a direction away from said movable jaw and into overlying relationship with a portion of said trailing end portion remote from said central portion.

20. A machine for wrapping a bundle of objects as set forth in claim 18 wherein said knife means comprise a movable blade having a first cutting edge, stationary blade means on said frame having a second cutting edge for coacting with said first cutting edge, and means for actuating said movable blade means to effect a shearing action relative to said stationary blade means, said outer end of said leading end portion lying beyond said stationary blade means after said moving means moves said leading end portion into overlying realtionship with said trailing end portion whereby said first cutting edge coacts with said second cutting edge to cause said leading and trailing end positions to be trimmed substantially flush with each other.

21. A machine for wrapping a bundle of objects with a central portion of a length of adhesive tape having opposite side edge portions and having leading and trailing end portions of tape on opposite sides of said central portion, said length of adhesive tape having an adhesive surface on one surface thereof, and said machine causing said leading and trailing end portions of said tape to adhere to each other in sutface-to-surface relationship to maintain said bundle of objects in a wrapped condition comprising a frame, means on said frame for mounting a length of tape, a recess in said frame, means on said frame for engaging said tape and advancing said predetermined length thereof in overlying relationship to said recess with said adhesive surface facing away from said recess, guide means on said frame for guiding said strip of tape in a predetermined linear path when said strip of tape is being advanced across said recess, a stationary jaw on one side of said recess, a movable jaw on the opposite side of said recess from said stationary jaw, means for moving said movable jaw toward said stationary jaw after said central portion of said tape is forced into said recess by said bundle to thereby move said leading and trailing end portions toward each other to cause said upper surfaces thereof to adhere to each other in said surface-to-surface relationship after said guide means cause corresponding side edge portions of said leading and trailing end portions to be in substantial alignment while said movable jaw is moving toward said stationary jaw to, thereby cause said corresponding side edge portions of said leading and trailing end portions to be substantially flush with each other after they have adhered to each other, said guide means on said frame including first channel means on said one side of said recess and second channel means on said opposite side of said recess, third channel means on said movable jaw in axial alignment with said first and second means for guiding said leading end portion of said tape into alignment with said trailing end portion with said opposite edge portions in substantial alignment as said movable jaw moves toward said stationary jaw, said third channel means comprising a pair of spaced elongated ridges, and depression means in said stationary jaw for receiving said spaced elongated ridges when said movable jaw is in closed engagement with said stationary jaw.

22. A machine for wrapping a bundle of objects with a central portion of a length of adhesive tape having opposite side edge portions and having leading and trailing end portions of tape on opposite sides of said central portion, said length of adhesive tape having an adhesive surface on one surface thereof, and said machine causing said leading and trailing end portions of said tape to adhere to each other in surface-to-surface relationship to maintain said bundle of objects in a wrapped condition comprising a frame, means on said frame for mounting a length of tape, a recess in said frame, means on said frame for engaging said tape and advancing said predetermined length thereof in overlying relationship to said recess with said adhesive surface facing away from said recess, guide means on said frame for guiding said strip of tape in a predetermined linear path when said strip of tape is being advanced across said recess, a stationary jaw on one side of said recess, a movable jaw on the opposite side of said recess from said stationary jaw, means for moving said movable jaw toward said stationary jaw after said central portion of said tape is forced into said recess by said bundle to thereby move said leading and trailing end portion toward each other to cause said upper surfaces thereof to adhere to each other in said surface-to-surface relationship after said guide means cause corresponding side edge portions of said leading and trailing end portions to be in substantial alignment while said movable jaw is moving toward said stationary jaw to thereby cause said corresponding side edge portions of said leading and trailing end portions to be substantially flush with each other after they have adhered to each other, trimming means for trimming the outer ends of said leading and trailing end portions to cause said outer trimmed ends to be substantially flush with each other, said trimming means including knife means in said frame, and moving means for moving said leading end portion into overlying relationship with said trailing end portion in the path of said knife means, said moving means comprising protuberance means on said movable jaw for bending a portion of said leading end portion which is remote from said central portion in a direction away from said movable jaw and into overlying relationship with a portion of said trailing end portion remote from said central portion, said protuberance means comprising a tongue member, means for resiliently securing said tongue member to said movable jaw, an upper edge on said stationary jaw, said tongue member extending outwardly from said movable jaw so as to overlie said upper edge of said stationary jaw when said movable jaw is pressing engagement with said stationary jaw.

23. A machine for wrapping a bundle of objects as set forth in claim 22 wherein said tongue member has an outer tip which is rounded, and wherein said upper edge of said stationary jaw is rounded, and wherein there is an interferance fit between said rounded outer tip and said rounded upper edge so that said outer tip of said tongue member rides up onto said upper edge of said stationary jaw when said movable jaw is in pressing engagement with said stationary jaw.

24. A machine for wrapping a bundle of objects with a central portion of a length of adhesive tape having opposite side edge portions and having leading and trailing end portions of tape on opposite sides of said central portion, said length of adhesive tape having an adhesive surface on one surface thereof, and said machine causing said leading and trailing end portions of said tape to adhere to each other in surface-to-surface relationship to maintain said bundle of objects in a wrapped condition comprising a frame, means on said frame for mounting a length of tape, a recess in said frame, means on said frame for engaging said tape and advancing said predetermined length thereof in overlying relationship to said recess with said adhesive facing away from said recess, guide means on said frame for guiding said strip of tape in a predetermined linear path when said strip of tape is being advanced across said recess, a stationary jaw on one side of said recess, a movable jaw on the opposite side of said recess from said stationary jaw, means for moving said movable jaw toward said stationary jaw after said central portion of said tape is forced into said recess by said bundle to thereby move said leading and trailing end portions toward each other to cause said upper surfaces thereof to adhere to each other in said surface-to-surface relationship after said guide means cause corresponding side edge portions of said leading and trailing end portions to be in substantial alignment while said movable jaw is moving toward said stationary jaw to thereby cause said corresponding side edge portions of said leading and trailing end portions to be substantially flush with each other after they have adhered to each other, trimming means for trimming the outer ends of said leading and trailing end portions to cause said outer trimmed ends to be substantially flush with each other, said trimming means including knife means in said frame, and moving means for moving said leading end portion into overlying relationship with said trailing end portion in the path of said knife means, said knife means comprising a guillotine type of blade having a pair of first spaced cutting edges, a pair of second cutting edges on said frame each of which coacts with one of said first cutting edges, an open space in said frame between said second cutting edges, and means for actuating said movable blade to cause each of said first cutting edges to effect a cutting action with one of said second cutting edges, said outer end of said leading end portion lying between said second cutting edges after said moving means moves said leading end portion into overlying relationship with said trailing end portion to thereby cause said first cutting edges to coact with said second cutting edges to cut a length of tape equal to the distance between said second cutting edges from said trailing end portion and to cut off the extreme end portion of said leading end portion which lies between said second cutting edges to thereby in turn cause said extreme outer edges at the ends of said leading and trailing end portions of said tape to be substantially flush with each other and to cause the extreme outer edge of a leading end portion of a subsequent length of tape to be cut at a predetermined location, said portion of said tape which is to be cut from said outer ends of said leading and trailing end portions comprising scrap which falls into said open space between said second knife edges.

25. A machine for wrapping a bundle of objects with a central portion of a length of adhesive tape having opposite side edge portions and having leading and trailing end portions of tape on opposite sides of said central portion, said length of adhesive tape having an adhesive surface on one surface thereof, and said machine causing said leading and trailing end portions of said tape tape adhere to each other in surface-to-surface relationship to maintain said bundle of objects in a wrapped condition comprising a frame, means on said frame for mounting a length of tape, a recess in said frame, means on said frame for engaging said tape and advancing said predetermined length thereof in overlying relationship to said recess with said adhesive surface facing away from said recess, guide means on said frame for guiding said strip of tape in a predetermined linear path when said strip of tape is being advanced across said recess, a stationary jaw on one side of said recess, a movable jaw on the opposite side of said recess from said stationary jaw, means for moving said movable jaw toward said stationary jaw after said central portion of said tape is forced into said recess by said bundle to thereby move said leading and trailing end portions toward each other to cause said upper surfaces thereof to adhere to each other in said surface-to-surface relationship after said guide means cause corresponding side edge portions of said leading and trailing end portions to be in substantial alignment while said movable jaw is moving toward said stationary jaw to thereby cause said corresponding side edge portions of said leading and trailing end portions to be substantially flush with each other after they have adhered to each other, trimming means for trimming the outer ends of said leading and trailing end portions to cause said outer trimmed ends to be substantially flush with each other, said trimming means including knife means in said frame, and moving means for moving said leading end portion into overlying relationship with said trailing end portion in the path of said knife means, said knife means comprising a movable blade means having a first cutting edge, stationary blade means on said frame having a second cutting edge for coacting with said first cutting edge, and means for actuating said movable blade means to effect a shearing action relative to said stationary blade means, said other end of said leading end portion lying beyond said stationary blade means after said moving means moves said leading end portion into overlying relationship with said trailing end portion whereby said first cutting edge coacts with said second cutting edge to cause said leading and trailing end portions to be trimmed substantially flush with each other, said length of adhesive tape being located at the end of and is a continuation of a strip of tape of indeterminate length and said movable blade means including a third cutting edge spaced from said first cutting edge, and said stationary blade means including a fourth cutting edge spaced from said second cutting edge for coacting with said third cutting edge, whereby a portion of said trailing end portion which extends beyond said leading end portion is trimmed from said strip of tape to thereby cause the remainder of said strip of tape to have a clean cut edge of a single thickness.

26. A machine for wrapping a bundle of objects with a central portion of a length of adhesive tape having opposite side edge portions and having leading and trailing end portions of tape on opposite sides of said central portion, said length of adhesive tape having an adhesive surface on one surface thereof, and said machine causing said leading and trailing end portions of said tape to adhere to each other in surface-to-surface relationship to maintain said bundle of objects in a wrapped condition comprising a frame, means on said frame for mounting a length of tape, a recess in said frame, means on said frame for engaging said tape and advancing said predetermined length thereof in overlying relationship to said recess with said adhesive surface facing away from said recess, guide means on said frame for guiding said strip of tape in a predetermined linear path when said strip of tape is being advanced across said recess, a stationary jaw on one side of said recess, a movable jaw on the opposite side of said recess from said stationary jaw, means for moving said movable jaw toward said stationary jaw after said central portion of said tape is forced into said recess by said bundle to thereby move said leading and trailing end portions toward each other to cause said upper surfacee thereof to adhere to each other in said surface-to-surface relationship after said guide means cause corresponding side edge portions of said leading and trailing end portions to be in substantial alignment while said movable jaw is moving toward said stationary jaw to thereby cause said corresponding side edge portions of said leading and trailing end portions to be substantially flush with each other after they have adhered to each other, trimming means for trimming the outer ends of said leading and trailing end portions to cause said outer trimmed ends to be substantially flush with each other, said guide means on said frame including first channel means on said one side of said recess, and second channel means on said opposite side of said recess, said guide means including means on said one side of said recess for guiding said leading end portion from said first channel means into said second channel means as said tape is being advanced across said recess, third channel means on said movable jaw in axial alignment with said first and second channel means for guiding said leading end portion of said tape into alignment with said trailing end portion with said opposite edge portions in substantial alignment as said movable jaw moves toward said stationary jaw, said third channel means comprising pair of spaced elongated ridges, and depression means in said stationary jaw for receiving said spaced elongated ridges when said movable jaw is in closed engagement with said stationary jaw.

27. A machine for wrapping a bundle of objects with a central portion of a predetermined length of adhesive tape having opposite edge portions and having leading and trailing end portions of tape at opposite ends of said central portion and having adhesive on one surface thereof, said machine causing said leading and trailing end portions of said tape to adhere to each other in surface-to-surface relationship to maintain said bundle of objects in a wrapped condition comprising a frame, means on said frame for mounting a strip of tape containing a plurality of said predetermined lengths of tape, a recess in said frame, first motor means on said frame on one side of said recess for advancing said predetermined length of said tape to a position with said central portion in overlying relationship to said recess and with said adhesive surface facing away from said recess and with said trailing end portion on said one side of said recess and with said leading end portion on the opposite side of said recess, first guide means on said frame on said one side of said recess for guiding said tape as it approaches said recess, second guide means on said frame on said opposite side of said recess for guiding said tape after it crosses said recess, a stationary jaw on said frame on said one side of said recess, a movable jaw on said other side of said recess, second motor means, first control means for causing said second motor means to move said movable jaw toward said stationary jaw in response to the placement of said bundle onto the surface of said central portion and moving said bundle and said central portion into said recess to thereby move said leading end portion toward said trailing end portion to cause said surfaces thereof to adhere to each other in surface-to-surface relationship after said first guide means maintains said trailing end portion in a predetermined alignment and said second guide means maintains said leading end portion in alignment with said trailing end as said leading end portion is withdrawn from said guide means as said bundle forces said central portion into said recess to thereby cause corresponding edge portions of said leading and trailing end portions to be in substantial alignment with each other, knife means on said frame on said one side of said recess, third motor means coupled to said knife means, second control means for actuating said third motor means to actuate said knife means to separate said length of tape from said strip and to sever the extreme end portions of said leading and trailing ends after said surfaces of said leading and trailing end portions have adhered to each other so that they are substantially even with each other, and third control means responsive to the removal of said bundle from said recess for actuating said first motor means to advance said predetermined length of tape with its central portion across said recess.

28. A machine for wrapping a bundle of objects with a central portion of a predetermined length of adhesive tape having opposite side edge portions and having leading and trailing end portions of tape at opposite ends of said central portion and having adhesive on one surface thereof, said machine causing said leading and trailing end portions of said tape to adhere to each other in surface-to-surface relationship to maintain said bundle of objects in a wrapped condition comprising a frame, means on said frame for mounting a strip of tape containing a plurality of said predetermined lengths of tape, a recess in said frame, first motor means on said frame on one side of said recess for advancing said predetermined length of said tape to a position with said central portion in overlying relationship to said recess and with said adhesive surface facing away from said recess and with said trailing end on said one side of said recess and with said leading end on the opposite side of said recess, first guide means on said frame on said one side of said recess for guiding said tape as it approaches said recess, second guide means on said frame on said opposite side of said recess for guiding said tape after it crosses said recess, a stationary jaw on said frame on said one side of said recess, a movable jaw on said other side of said recess, second motor means, first control means for causing said second motor means to move said movable jaw toward said stationary jaw in response to the placement of said bundle onto the surface of said central portion and moving said bundle and said central portion into said recess to thereby move said leading end portion toward said trailing end portion to cause said surfaces thereof to adhere to each other in surface-to-surface relationship after said first guide means maintains said trailing end in a predetermined alignment and said second guide means maintains said leading end in alignment with said trailing end as said leading end is withdrawn from said second guide means as said bundle forces said central portion into said recess to thereby cause corresponding side edge portions of said leading and trailing ends to be in substantial alignment with each other, knife means on said frame on said one side of said recess, third motor means coupled to said knife means, second control means for actuating said third motor means to sever the extreme ends of said leading and trailing ends so that they are substantially even with each other, third control means responsive to the removal of said bundle from said recess for actuating said first motor means to advance said predetermined length of tape with its central portion across said recess, said movable jaw having a face in opposition to said stationary jaw, and third guide means on said face of said movable jaw for also guiding said leading end as said movable jaw moves toward said stationary jaw.

29. A machine for wrapping a bundle of objects with a central portion of a predetermined length of adhesive tape having opposite side edge portions and having leading and trailing end portions of tape at opposite ends of said central portion and having adhesive on one surface thereof, said machine causing said leading and trailing end portions of said tape to adhere to each other in surface-to-surface relationship to maintain said bundle of objects in a wrapped condition comprising a frame, means on said frame for mounting a strip of tape containing a plurality of said predetermined lengths of tape, a recess in said frame, first motor means on said frame on one side of said recess for advancing said predetermined length of said tape to a position with said central portion in overlying relationship to said recess and with said adhesive surface facing away from said recess and with said trailing end on said one side of said recess and with said leading end on the opposite side of said recess, first guide means on said frame on said one side of said recess for guiding said tape as it approaches said recess, second guide means on said frame on said opposite side of said recess for guiding said tape after it crosses said recess, a stationary jaw on said frame on said one side of said recess, a movable jaw on said said other side of said recess, second motor means, first control means for causing said second motor means to move said movable jaw towards said stationary jaw in response to the placement of said bundle onto the surface of said central portion and moving said bundle and said central portion into said recess to thereby move said leading end portion toward said trailing end portion to cause said surfaces thereof to adhere to each other in surface-to-surface relationship after said first guide means maintain said trailing end in a predetermined alignment and said second guide means maintains said leading end in alignment with said trailing end as said leading end is withdrawn from said second guide means as said bundle forces said central portion into said recess to thereby cause corresponding side edge portions of said leading and trailing ends to be in substantial alignment with each other, knife means on said frame on said one side of said recess, third motor means coupled to said knife means, second control means for actuating said third motor means to sever the extreme ends of said leading and trailing ends so that they are substantially even with each other, third control means responsive to the removal of said bundle from said recess for actuating said first motor means to advance said predetermined length of tape with its central portion across said recess, wiper means operatively associated with said movable jaw for pressing intermediate portions of said leading and trailing ends together, said intermediate portions lying between said central portion and the other ends of said leading and trailing ends, fourth motor means coupled to said wiper means, and fourth control means for causing said fourth motor means to cause said wiper means to press said intermediate portions together after said movable jaw presses said extreme outer ends together.

30. A machine for wrapping a bundle of objects with the central portion of a length of adhesive tape having an adhesive surface on one side thereof and causing the end portions of said adhesive tape on opposite sides of said central portion to adhere to each other in face-to-face relationship to maintain said bundle of elongated objects in a wrapped condition comprising a frame, a recess in said frame, a side wall on one side of said recess, open mouth means in said recess for underlying said central portion of said length of adhesive tape with said adhesive surface facing away from said recess whereby when said bundle of elongated objects is placed on said surface of said central portion of said length of adhesive tape and moved away from said open mouth and into said recess said central portion will wrap around a portion of said bundle of elongated objects and said surfaces on said end portions of said adhesive tape will be oriented in facing relationship to each other within said recess, pressing means on said frame located in spaced opposition to said side wall, motor means for selectively moving said pressing means toward said side wall to thereby move the facing surface on one of said end portions into engagement with the facing surface on the end portion which is proximate said side wall by pressing said facing end portions between said pressing means and said side wall to thereby adhesively join said facing surfaces on each of said end portions of said length of adhesive tape to each other to thereby produce a wrap around said bundle of elongated objects, and wiping means proximate said recess located in opposition to said side wall and oriented between said pressing means and said bundle of elongated objects for wiping across said facing end portions toward said bundle of elongated objects below said pressed adhesively joined end portions to thereby further adhesively secure said facing end portions to each other to increase the length of said adhesively joined end portions and thus tighten said wrap around said bundle of elongated objects.

31. A machine for wrapping a bundle of objects with the central portion of a first length of tape having opposite side edge portions and a leading end portion and a trailing end portion on opposite sides of said central portion and having an adhesive surface on one surface thereof, and said machine causing said leading end portion and said trailing end portion to adhere to each other in surface-to-surface relationship to hold said bundle of objects in a wrapped condition comprising a frame, means on said frame for mounting said length of tape, a recess in said frame, means on said frame for advancing said leading end portion of said first length of tape across said recess to cause a portion of said first length of tape to lie in overlying relationship to said recess with said adhesive surface facing away from said recess, a pair of jaws on opposite sides of said recess, means for moving said jaws toward each other after said central portion of said tape is forced into said recess by said bundle to thereby move said leading and trailing end portions toward each other to cause said upper surfaces thereof to adhere to each other in said surface-to-surface relationship, guide means on said frame for engaging said opposite side edge portions and guiding said leading end of said first length of tape in a predetermined path when said first length of tape is being advanced across said recess and for causing corresponding side edge portions of said leading end portion and said trailing end portion to be in substantial alignment after said jaws have moved toward each other to cause said upper surfaces of said leading and trailing end portions to adhere to each other and cause said corresponding side edge portions of said leading and trailing end portions to be substantially flush with each other after they have adhered to each other, first trimming means mounted relative to one of said jaws for trimming said extreme outer end portions from said adhered leading and trailing end portions to cause said outer ends of said leading and trailing end portions to be substantially flush with each other, and second trimming means spaced from said first trimming means for trimming the leading end portion of a second length of tape from which said first length of tape is being severed by said first timing means to thereby remove a portion of tape between said leading end portion of said second length of tape and said flush outer ends of said leading and trailing end portions of said first length of tape.

* * * * *

UNITED STATES PATENT AND TRADEMARK OFFICE

CERTIFICATE OF CORRECTION

PATENT NO. : 4,852,329

DATED : August 1, 1989

INVENTOR(S) : Louis Terragnoli

It is certified that error appears in the above-identified patent and that said Letters Patent is hereby corrected as shown below:

Column 4, line 16, delete the comma after "portion".
Column 7, line 24, after "will be" insert --a--.
Column 12, line 19, delete "o" after "173'";
line 58, change "ofrreasons" to --of reasons--.
Column 13, line 63, change "blade 15" to --blade 215--.
Column 16, line 2, change "tee" to --the--.
Column 18, line 62 (claim 12), after "tape" insert --still--.
Column 19, line 2 (claim 13), change "39" to --12--;
line 38 (claim 18), before "means" insert --trimming--;
line 54 (claim 20), after "blade" insert --means--.
Column 20, line 26 (claim 21), delete the comma after "to";
line 34 (claim 21), after "second" insert --channel--;
line 65 (claim 22), change "portion" to --portions--.
Column 21, line 25 (claim 22), after "is" insert --in--.
Column 22, line 39 (claim 25), change "tape" (second occurrence) to --to--.
Column 23, line 8 (claim 25), change "other" to --outer--;
line 25 (claim 25), after "cut" insert --end--;
line 49 (claim 26), change "surfacee" to --surfaces--.
Column 24, line 6 (claim 26), before "pair" insert --a--;

Column 26, line 3 (claim 29), delete "said" (fourth occurrence);
line 6 (claim 29), change "towards" to --toward--;
line 13 (claim 29), change "maintain" to --maintains--;
line 33 (claim 29), change "other" to --outer--.
Column 28, line 24 (claim 31), change "timing" to --trimming--.

UNITED STATES PATENT AND TRADEMARK OFFICE

CERTIFICATE OF CORRECTION

PATENT NO. : 4,852,329

DATED : August 1, 1989

INVENTOR(S) : Louis Terragnoli

It is certified that error appears in the above-identified patent and that said Letters Patent is hereby corrected as shown below:

ADD THE FOLLOWING CLAIMS:

32. A machine for wrapping a bundle of objects as set forth in claim 25 wherein said strip of tape is in the form of a roll, and means for mounting said roll on said frame.

33. A machine for wrapping a bundle of objects as set forth in claim 25 including duct means in said frame underlying said movable knife for receiving a scrap consisting of the extreme end portions of said leading and trailing end portions severed by said knife means.

Signed and Sealed this

Twenty-sixth Day of June, 1990

*Attest:*

HARRY F. MANBECK, JR.

*Attesting Officer*

*Commissioner of Patents and Trademarks*